US005545514A

United States Patent [19]

Kita et al.

[11] Patent Number: 5,545,514

[45] Date of Patent: Aug. 13, 1996

[54] SILVER HALIDE LIGHT-SENSITIVE COLOR PHOTOGRAPHIC MATERIAL

[75] Inventors: Hiroshi Kita; Hirokazu Sato; Koji Daifuku, all of Hino, Japan

[73] Assignee: Konica Corporation, Tokyo, Japan

[21] Appl. No.: 500,822

[22] Filed: Jul. 11, 1995

[30] Foreign Application Priority Data

Jul. 14, 1994 [JP] Japan ..... 6-162230

[51] Int. Cl.[6] ..... G03C 7/388

[52] U.S. Cl. ..... 430/546; 430/551; 430/558

[58] Field of Search ..... 430/551, 546, 430/631, 558

[56] References Cited

U.S. PATENT DOCUMENTS

| | | | |
|---|---|---|---|
| 2,240,469 | 4/1941 | Swan et al. | 430/631 |
| 2,360,290 | 10/1944 | Vittum et al. | 430/372 |
| 2,423,514 | 7/1947 | Miller | 12/85.9 |
| 2,423,730 | 7/1947 | Salminen | 430/473 |
| 2,801,171 | 7/1957 | Fierke et al. | 430/546 |
| 3,069,262 | 12/1962 | Haas | 430/237 |
| 3,432,300 | 3/1969 | Lestina et al. | 430/505 |
| 3,573,050 | 3/1971 | Brannock et al. | 430/512 |
| 3,574,627 | 4/1971 | Stern et al. | 430/551 |
| 3,684,514 | 8/1972 | Iwama et al. | 430/554 |
| 3,725,067 | 4/1973 | Bailey et al. | 430/558 |
| 4,015,990 | 4/1977 | Ishida et al. | 430/551 |
| 4,970,139 | 11/1990 | Baguhi | 430/546 |
| 5,376,520 | 12/1994 | Kita et al. | 430/546 |

FOREIGN PATENT DOCUMENTS

| | | | |
|---|---|---|---|
| 0084692 | 8/1983 | European Pat. Off. | 430/546 |
| 0601836A2 | 6/1994 | European Pat. Off. . | |
| 3156442 | 7/1991 | Japan | 430/631 |
| 1436994 | 5/1976 | United Kingdom | 430/546 |
| 86/02264 | 4/1986 | WIPO . | |

*Primary Examiner*—Lee C. Wright

*Attorney, Agent, or Firm*—Finnegan, Henderson, Farabow, Garrett & Dunner, L.L.P.

[57] ABSTRACT

A silver halide color photographic light-sensitive material is disclosed. The light-sensitive material has a silver halide emulsion layer which contains oleophilic particles comprising a dye-forming coupler and a water-insoluble monohydric alcohol represented by the following Formula I, II or III;

Formula I wherein m is an integer of 1 to 20; one of $R_{11}$, $R_{12}$ and $R_{13}$ in number of m is a hydrogen atom and other groups represented by $R_{11}$, $R_{12}$ and $R_{13}$ are each an acyl group; and the total number of carbon atoms contained in the acyl groups represented by $R_{11}$, $R_{12}$ and $R_{13}$ are not less than 8;

Formula II wherein one of $R_{21}$, $R_{22}$, $R_{23}$ and $R_{24}$ is a hydrogen atom and other groups represented by $R_{21}$, $R_{22}$, $R_{23}$ and $R_{24}$ are each an acyl group and the total number of carbon atoms contained in the acyl groups represented by $R_{21}$, $R_{22}$, $R_{23}$ and $R_{24}$ is not less than 12;

Formula III wherein one of $R_{31}$, $R_{32}$, $R_{33}$ and $R_{34}$ is a hydrogen atom and other groups represented by $R_{31}$, $R_{32}$, $R_{33}$ and $R_{34}$ are each an acyl group and the total number of carbon atoms contained in the acyl groups represented by $R_{31}$, $R_{32}$, $R_{33}$ and $R_{34}$ is not less than 12.

5 Claims, No Drawings

SILVER HALIDE LIGHT-SENSITIVE COLOR PHOTOGRAPHIC MATERIAL

FIELD OF THE INVENTION

The present invention relates to a silver halide light-sensitive color photographic material and, more specifically, it relates to a silver halide light-sensitive color photographic material, which is capable of producing a dye image having improved durability against light and which has excellent dye-forming efficiency.

BACKGROUND OF THE INVENTION

In the field of silver halide light-sensitive color photographic material, which is hereinafter referred to simply as "Light-sensitive material", it is desirable that a dye image obtained from a coupler does not easily fades away or discolors even when it is exposed to light for a long time, or when it is stored under high temperature and high humidity conditions.

However, durability of the aye image against ultra-violet and visual rays is not in the state of satisfaction, and it has been known that the dye image can easily fadeout or discolor when it is irradiated by active rays. In order to eliminate such an disadvantage, various methods have been proposed; that is to say, a method of selecting various couplers which are less vulnerable to discoloration; a method of using a ultraviolet ray absorbent to protect the dye image from the ultraviolet rays and a method of introducing a group which is capable of conferring it on improved durability against light.

However in order to confer the dye image on sufficient durability against light, the use of a large amount of ultraviolet ray absorbent is necessary, and in this case, the dye image is often stained to a remarkable extent due to coloration of the ultraviolet ray absorbent itself. Moreover, the use of the ultraviolet ray absorbent does not exert influence upon anti-discoloration of the dye image and, thus, there is a limit to the improvement effect upon durability against light by the use of the ultraviolet ray absorbent.

Further a method of using an anti-discoloration agent, which is capable of producing a phenolic hydroxide group or the same by hydrolysis has been known in the art. For example, Japanese Patent Publication Nos.48-31256(1973), 48- 31625(1973 and 51-30462(1976); Japanese Patent O.P.I. Publication No.49-134326(1974) and 49-134327(1974) have proposed the use of phenolic and bis-phenolic-type compounds; U.S. Pat. No. 3,069,262 has proposed the use of pyrogallol compounds and esters thereof; U.S. Pat. Nos., 2,360,290 and 4,015990, α-tocopherol compounds and acylated derivatives thereof; Japanese Patent Publication No. 52-27534 and Japanese Patent O.P.I.. Publication No.52-14751 and U.S. Pat. No. 2,735,765, hydroquinone derivatives; U.S. Pat. Nos. 3,432,300 and 3,574,627, 6-hydroxychromans; U.S. Pat. No. 3,573,050 5-hydroxychroman derivatives and Japanese Patent Publication No. 49-20977, 6,6'-dihydroxy-2,2'-spirochroman compounds; etc. However, although these compounds have some effect as the anti-fading or anti-discoloration agents for the dye image, their effect is not sufficient.

Further an attempt of improving stability of the dye image against light by using an azomethine-type quenching compound is disclosed in British Patent No,1,451,000, however, since the azomethine quenching compound itself bears a color and, thus it is disadvantageous because effect of the compound upon hue of the dye image is large.

Further, a method of stabilizing durability of a dye against light by the use of metal complexes is disclosed in Research Disclosure No.15,162(1976) and Japanese Patent O.P.I. Publication No.50-87649(1975), however, since anti-discoloration effect of these metal complexes is relatively small and, in addition, solubility of these complexes in the organic solvent being not high, it is impossible to add sufficient amount necessary to exert anti-discoloration effect. Still further, since these complexes themselves bear color, they had an advertent effect on hue and purity of the dye image produced by color development.

The primary object of the present invention is to provide a silver halide light-sensitive color photographic material having excellent spectral absorption property and remarkably improved durability of the dye image produced therein against light.

The second object of the present invention is to provide a silver halide light-sensitive color photographic material having excellent dye-forming efficiency.

SUMMARY OF THE INVENTION

A silver halide color photographic light-sensitive material comprising a support and a silver halide emulsion layer provided on the support wherein the silver halide emulsion layer contains oleophilic fine particles dispersed therein which comprises a water-insoluble monohydric alcohol represented by the following Formula I, II or III and a color-forming coupler in a ratio of the water-insoluble monohydric alcohol to the color-forming coupler of 50 % or more by weight;

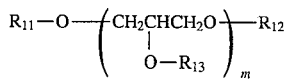

Formula I wherein m is an integer of 1 to 20; one of $R_{11}$, $R_{12}$ and $R_{13}$ in number of m is a hydrogen atom and other groups represented by $R_{11}$, $R_{12}$ and $R_{13}$ are each an acyl group; and the total number of carbon atoms contained in the acyl groups represented by $R_{11}$, $R_{12}$ and $R_{13}$ are not less than 8. It is preferable that the total number of carbon atoms included in the acyl groups represented by $R_{11}$, $R_{12}$ and $R_{13}$ are not more than 30+(30×m) . The plurality of acyl groups represented by $R_{11}$, $R_{12}$ and $R_{13}$ may be the same or different.

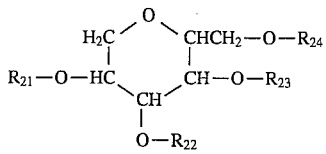

Formula II wherein one of $R_{21}$, $R_{22}$, $R_{23}$ and $R_{24}$ is a hydrogen atom and other groups represented by $R_{21}$, $R_{22}$, $R_{23}$ and $R_{24}$ are each an acyl group and the total number of carbon atoms included in the acyl groups is not less than 12. The total number of carbon atoms contained in the acyl groups represented by $R_{21}$, $R_{22}$, $R_{23}$ and $R_{24}$ are preferably not less than 90. The plurality of acyl groups represented by $R_{21}$, $R_{22}$, $R_{23}$ and $R_{24}$ may be the same or different.

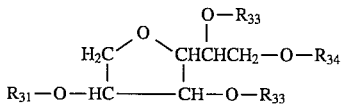

Formula III wherein one of $R_{31}$, $R_{32}$, $R_{33}$ and $R_{34}$ is a hydrogen atom and other groups represented by $R_{31}$, $R_{32}$, $R_{33}$ and $R_{34}$ are each an acyl group and the total number of carbon atoms included in the acyl groups is not less than 12. The total number of carbon atoms contained in the acyl groups represented by $R_{31}$, $R_{32}$, $R_{33}$ and $R_{34}$ are preferably not less than 90. The plurality of acyl groups represented by $R_{31}$, $R_{32}$, $R_{33}$ and $R_{34}$ may be the same or different.

In a preferable embodiment of the invention, the monohydric alcohol is contained in oleophilic fine particles dispersed in the emulsion layer, together with a color forming coupler. The ratio of the water-insoluble monohydric alcohol to the color-forming coupler in the oleophilic particles is preferably 50% or more by weight.

In the above, "water-insoluble monohydric alcohol" is defined as a monohydric alcohol which has a solubility of not more than 5 g per 100 g of water at 25° C. A monohydric alcohol having a solubility of not more than 1 g per 100 g of water at 25° C. is more preferably to be used.

DETAILED DESCRIPTION OF THE INVENTION

The water-insoluble monohydric alcohol compounds, hereinafter simply referred as "monohydric alcohol", represented by the Formulae I through III are explained.

The acyl group represented by In Formulae I through III, $R_{11}$, $R_{12}$, $R_{13}$, $R_{21}$, $R_{22}$, $R_{23}$, $R_{24}$, $R_{31}$, $R_{32}$, $R_{33}$ and $R_{34}$ is expressed by Formula IV below:

$$-C(=O)-R \qquad \text{Formula IV}$$

wherein R represents a substituted or unsubstituted alkyl group, an alkenyl group or an aryl group. The groups represented by R is a group containing 3 to 31, preferably 7 to 23, carbon atoms.

The alkyl group represented by R may be either straight-chain, branched or cyclic and, preferably one which contains 3 to 31 carbon atoms such as isopropyl group, octyl group, isoundecyl group, heptadecyl group, (t)octyl group and cyclohexl group.

The alkenyl group represented by R may be either straight-chain, branched or cyclic and, preferably one which contains three to 31 carbon atoms such as, propenyl group, 10-undecenyl group, 9-heptadecenyl group, and 1-methylpropenyl group.

The aryl group represented by R is preferably one containing six to 14 carbon atoms such as phenyl group, 1-naphthyl group and 2-naphthyl group.

The above-mentioned alkyl group, alkenyl group and aryl group may be substituted by a substituent. Such substituent includes, for example, an alkyl group, an alkenyl group, a cycloalkenyl group, an alkinyl group, an aryl group, a cycloalkenyl group, an alkinyl group, an aryl group, a heterocyclic group, an alkylthio group, an arylthio group, a heterocyclic thio group, an $-SO_2-Ra$ group, an $-SO-Ra$ group, a $-C(=O)-Ra$ group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an anilino group, an acylamino group, a sulfonamido group, an imido group, a ureide group, a sulfamoylamino group, an alkoxycarbonylamino group, an alkoxycarbonyl group, an aryloxycarbonyl group, a spiro compound residue, a bridged hydrocarbon carbon compound residue and a halogen atom. In the above, Ra is an alkyl group, an alkenyl group, a cycloalkenyl group, an alkinyl group or an aryl group.

Among those groups listed above, the preferables are alkyl and alkenyl groups and the especially preferable groups are alkyl and alkenyl groups containing 7 to 31 carbon atoms.

Preferable monohydric alcohol represented by Formulae I through III is one which is usually in the liquid state under the room temperature. Preferable monohydric alcohol represented by Formulae I through III is one of which hydroxyl value is not less than 50. Further, preferable monohydric alcohol represented by the Formulae I through III has a logP value of 3 or more. The monohydric alcohol of the invention has a solubility of not more than 5 g, preferably not more than 1 g, per 100 g of water at 25° C.

Below, specific examples of the monohydric alcohol represented by Formulae I through III are shown below. These compounds each has a solubility of less than 1 g to 100 g water at 25° C.

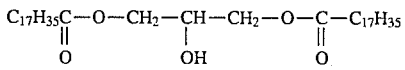

I-1

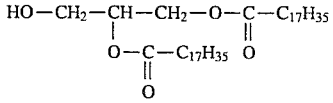

I-2

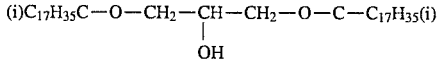

I-3

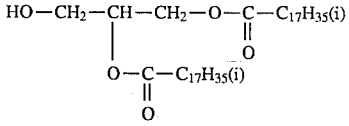

I-4

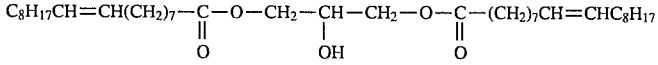

I-5

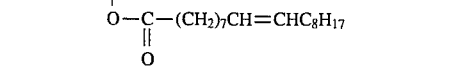

I-6

-continued
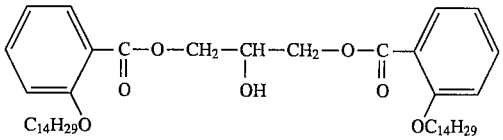
I-7
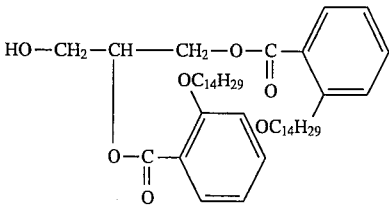
I-8
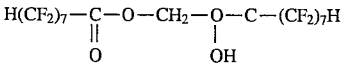
I-9
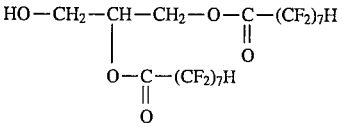
I-10
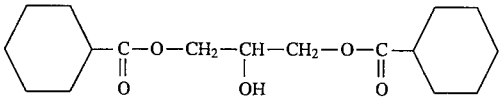
I-11
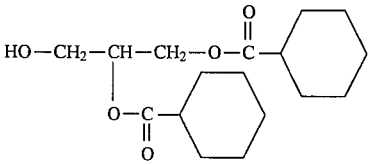
I-12
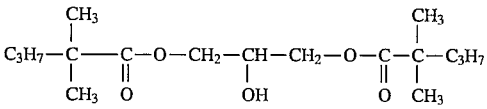
I-13
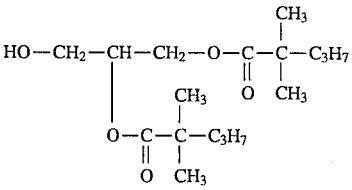
I-14
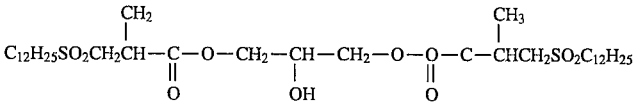
I-15
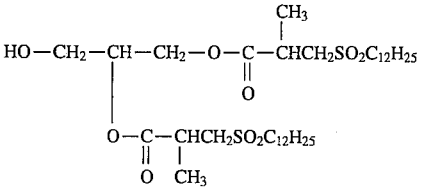
I-16
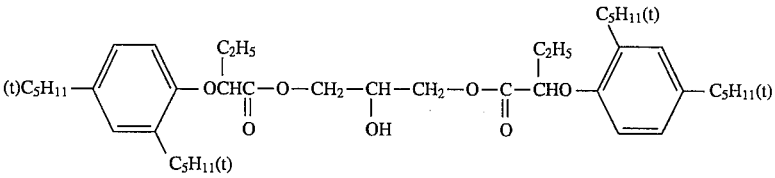
I-17

-continued
I-18
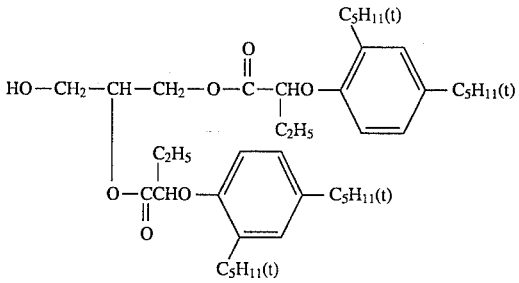
I-19
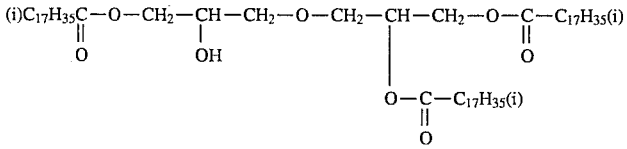
I-20
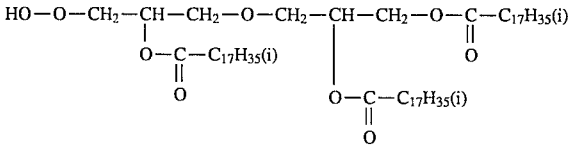
I-21
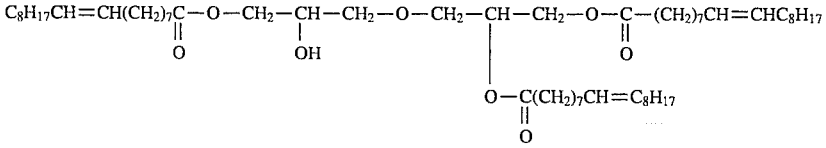
I-22
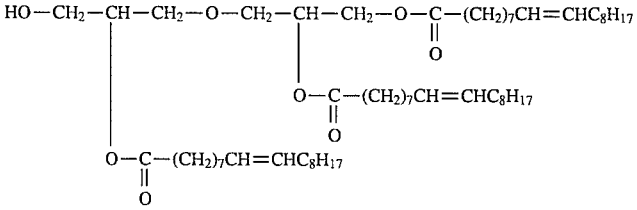
I-23
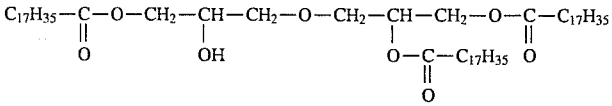
I-24
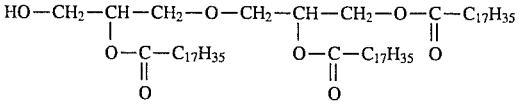
I-25
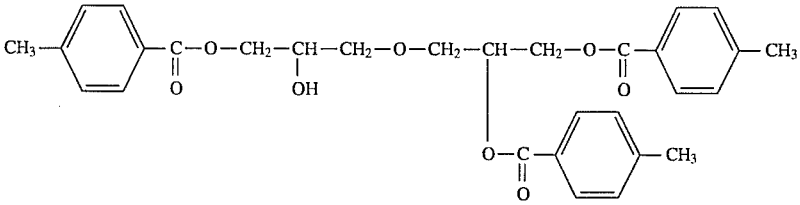
I-26
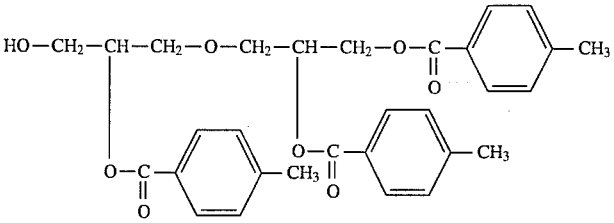

-continued
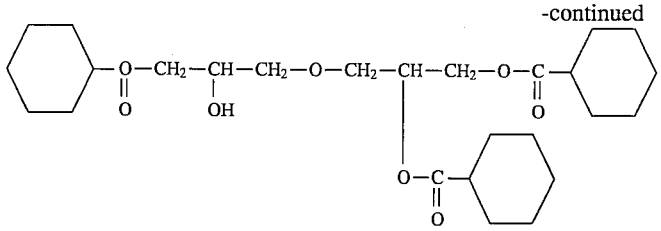
I-27
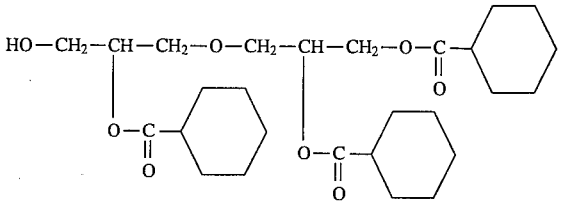
I-28
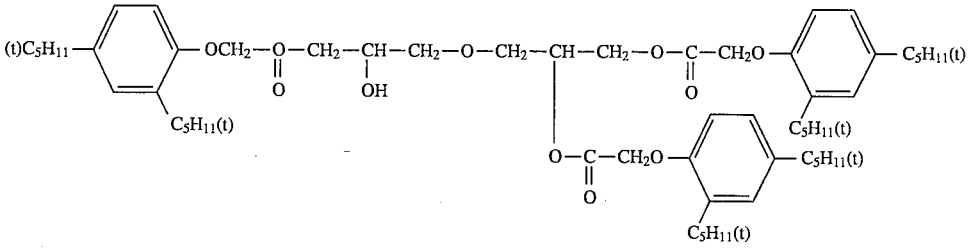
I-29
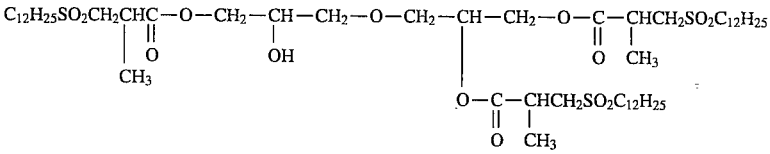
I-30
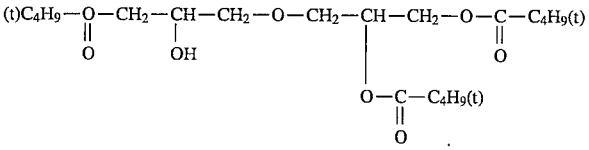
I-31
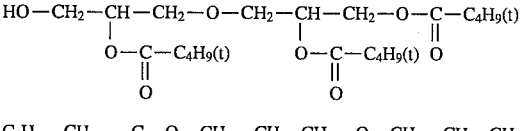
I-32
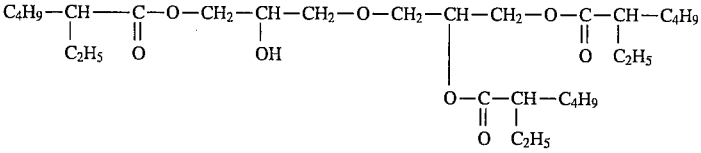
I-33
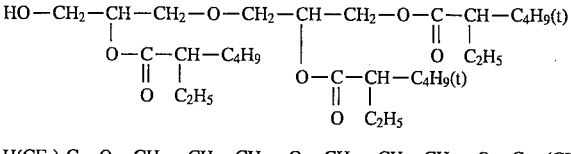
I-34
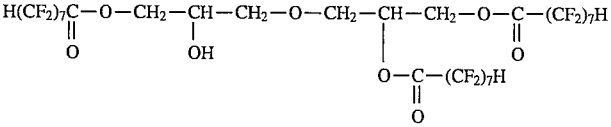
I-35
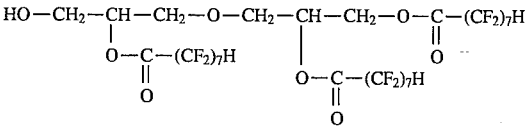
I-36

-continued
I-37
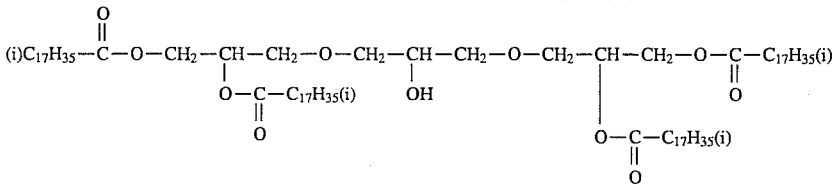
I-38
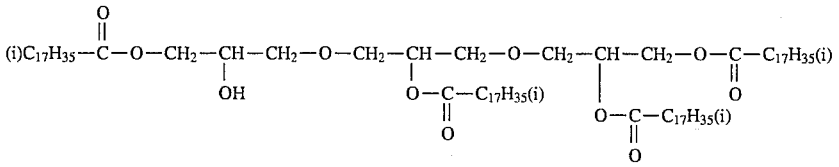
I-39
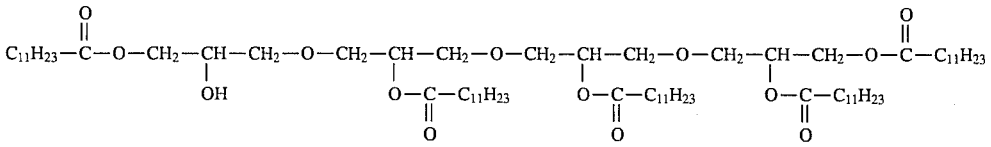
I-40
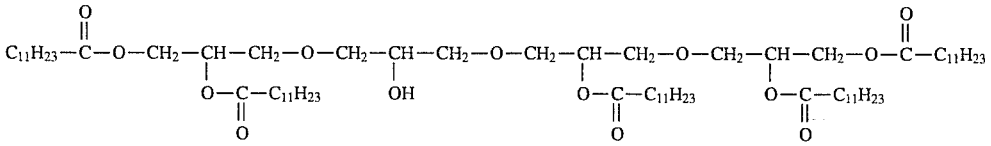
Glycerinedistearate(isomeric miuxture) I-41
Glycerindiolate(isomeric miuxture) I-42
Giglycerintriisostearate(isomeric miuxture) I-43
Diglycerintriolate(isomeric miuxture) I-44
Triglycerintristearate(isomeric miuxture) I-45
II-1
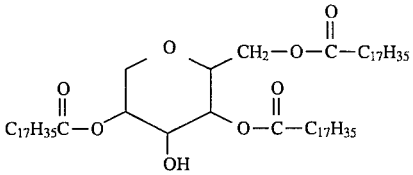
II-2
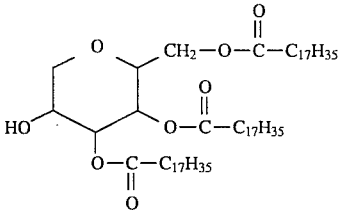
II-3
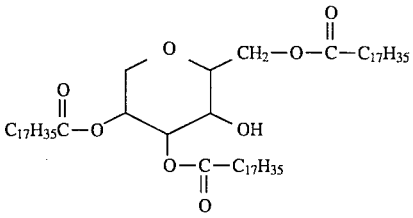

-continued
II-4
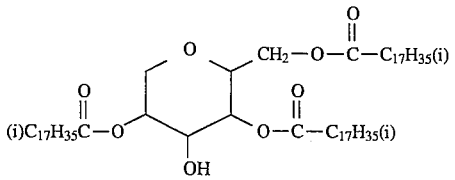
II-5
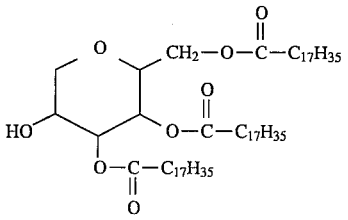
II-6
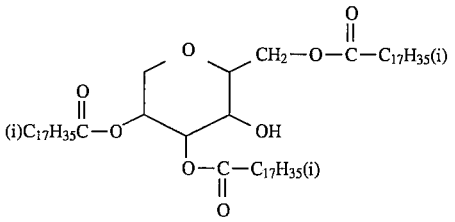
II-7
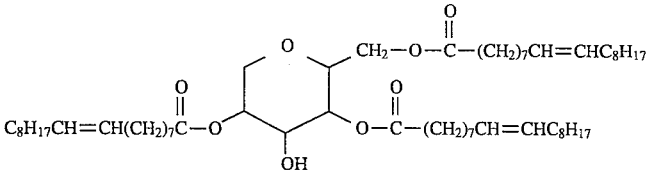
II-8
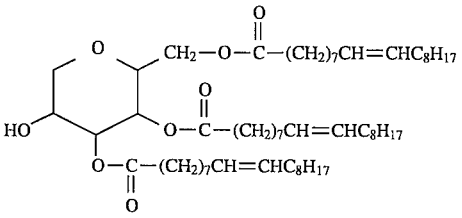
II-9
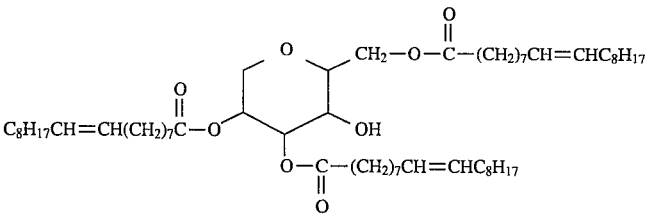
II-10
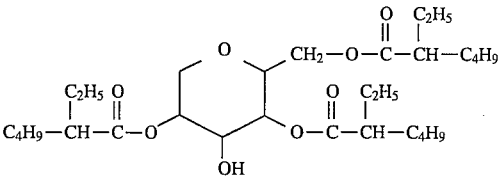
II-11
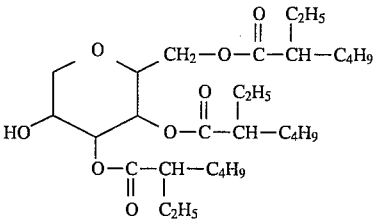

-continued
II-12
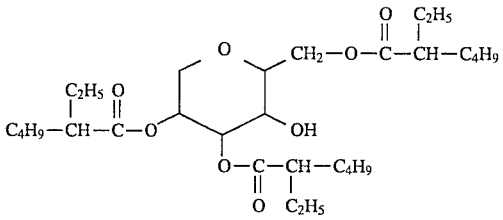
II-13
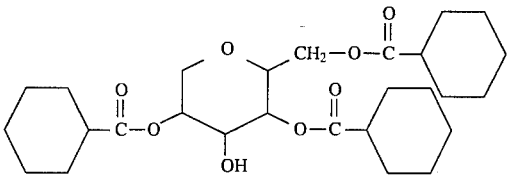
II-14
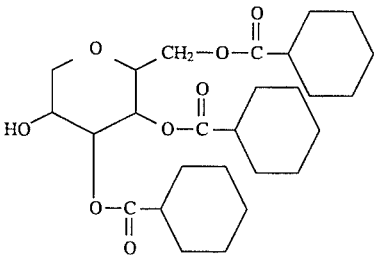
II-15
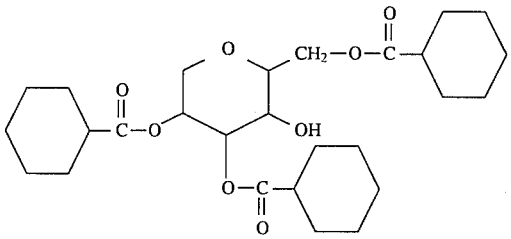
II-16
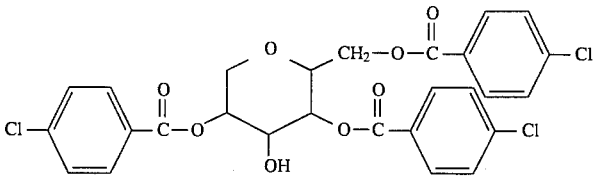
II-17
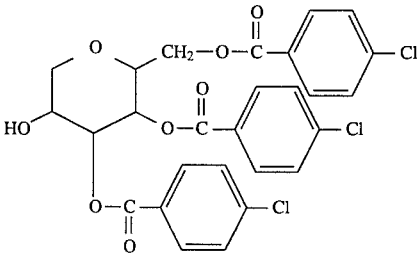
II-18
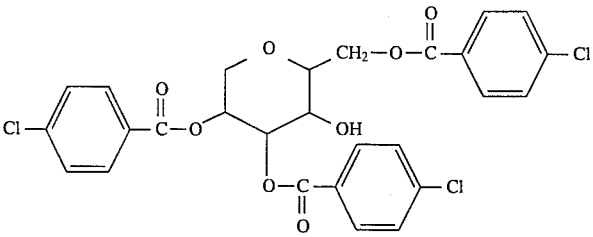

-continued
II-19
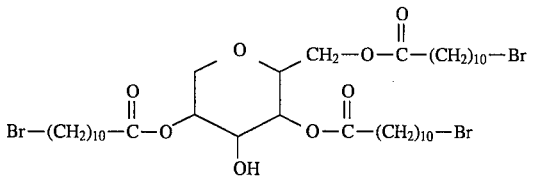
II-20
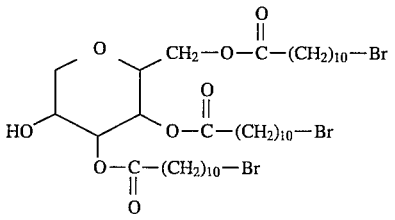
II-21
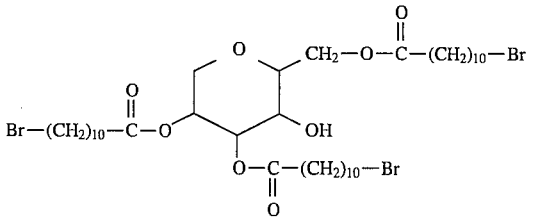
III-1
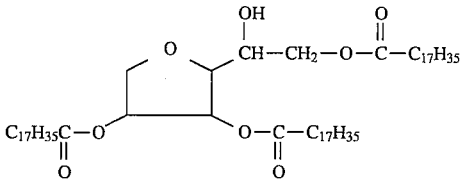
III-2
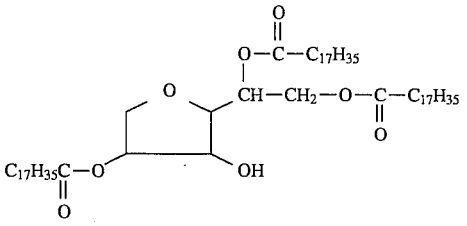
III-3
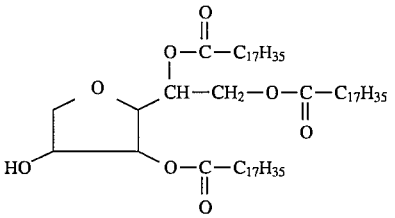
III-4
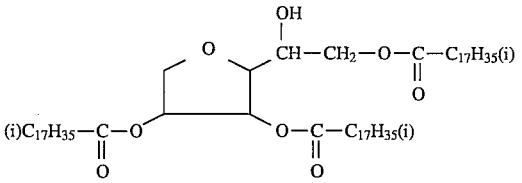
III-5
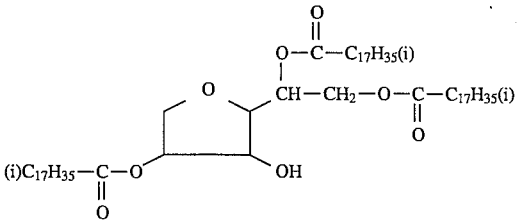

-continued
III-6
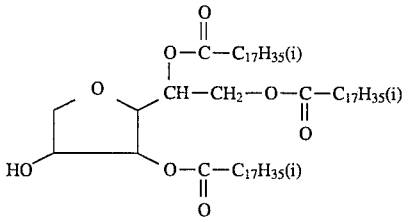
III-7
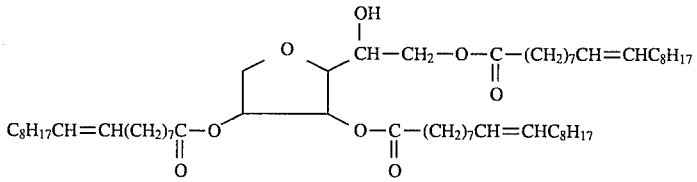
III-8
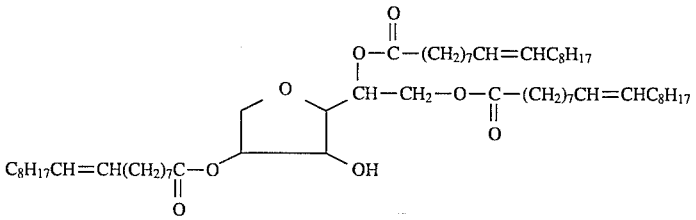
III-9
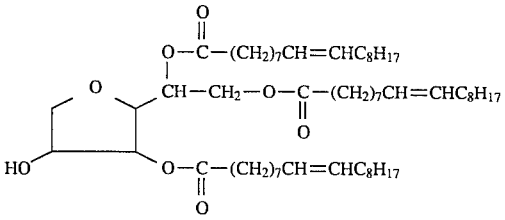
III-10
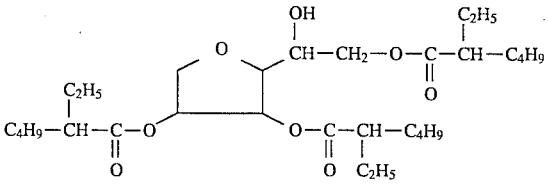
III-11
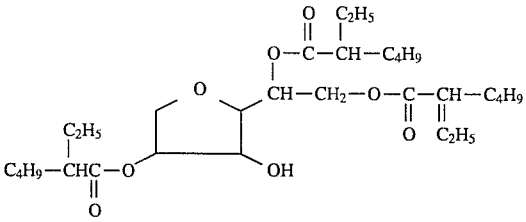
III-12
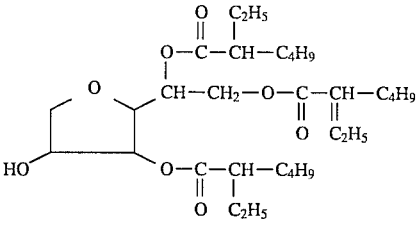

-continued
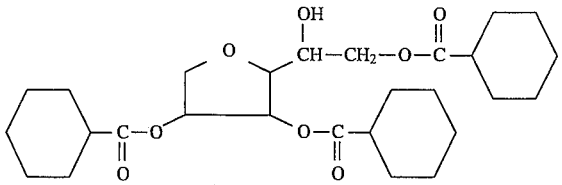
III-13
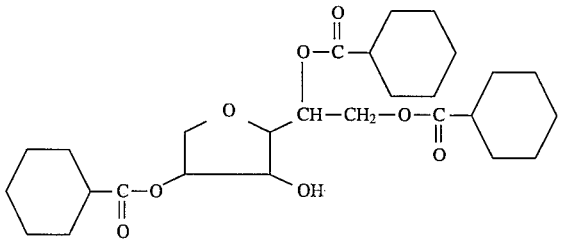
III-14
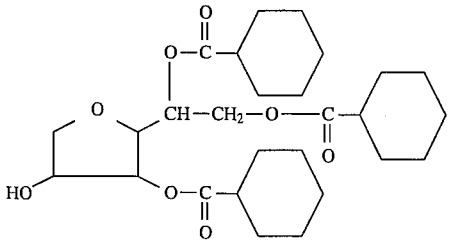
III-15
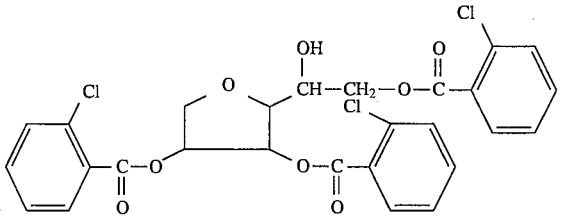
III-16
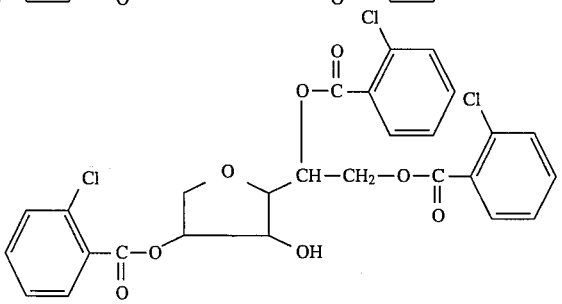
III-17
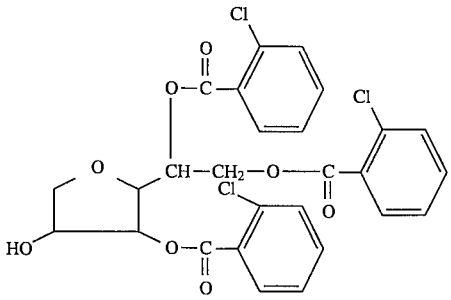
III-18

-continued

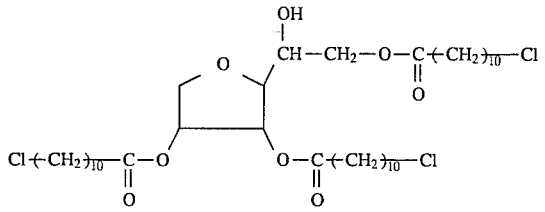

III-19

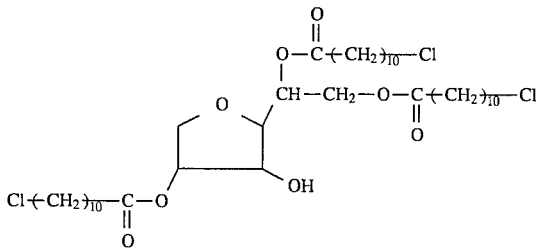

III-20

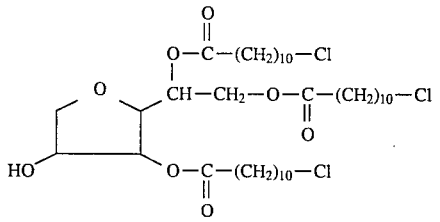

III-21

Srbitantriolate III-22

Sorbitantrisrearate III-23

Sorbitantriisostearate III-24

A silver halide color photographic material of the invention comprises a support and a silver halide emulsion layer provided on the support. The emulsion layer contains oleophilic fine particles dispersed therein, which comprises a color-forming coupler and the above-mentioned monohydric alcohol represented by Formula I, II or III. In the oleophilic particle, the monohydric alcohol functions as a high-boiling point solvent for the coupler. A high-boiling point solvent other than the monohydric alcohol may be used together with the monohydric alcohol. The amount of the monohydric alcohol is 0.5 g or more, preferably 0.5 to 8 g per gram of the coupler. Namely, the ratio of the monohydric alcohol to the coupler by weight is preferably not less than 50%, particularly, within the range of 50% to 800%. A color light-sensitive material generally has a blue-sensitive emulsion layer containing a yellow dye-forming coupler, a green-sensitive emulsion layer containing a magenta dye-forming coupler and a red-sensitive emulsion layer containing a cyan dye-forming coupler. In such case, the monohydric alcohol of the invention is applied at least one of these emulsion layers. However the effects of the invention is particularly enhanced when the monohydric alcohol is used with a magenta dye-forming coupler in combination. The coupler to be contained in the emulsion layer together with the monohydric alcohol includes cyan dye-forming couplers, magenta dye couplers and yellow dye-forming couplers each usually used in a color light-sensitive material.

In the present invention, yellow dye-forming couplers which can be used in combination with the monohydric alcohol of the present invention includes, for example, benzoylacetanilide-type and pivaloylacetanilide-type couplers can be mentioned; as for magenta dye-forming couplers, for example, 5-pyrazolon-type, pyrazolotriazole-type, pyrazolotetrazole-type and indazolon-type couplers can be mentioned and as for cyan dye-forming couplers, for example phenol-type, naphthol-type, pyrazoloquinazolon-type, pyrazolopyrimidine-type, pyrazolotriazole-type and imidazole-type couplers.

Besides those mentioned above, the yellow dye-forming couplers include those compounds disclosed, for example, West German Patent OLS No. 2,163,812, Japanese Patent O.P.I. Publication Nos. 47-26133 (1972). 48-29432 (1973), 50-65321 (1975), 51-3631 (1976), 51-50734 (1976). 51-102636 (1976), 48-66385(1973), 48-94432(1973), 49-1229(1974), 49-10736(1974), 51-33410(1976) and 52-25733 (1977) and these compounds may be synthesized with reference to the method disclosed therein.

As a magneta coupler which can be used in combination with the monohydric alcohol of the invention, a magenta dye-forming coupler represented by the following Formula V or VI is particularly preferable;

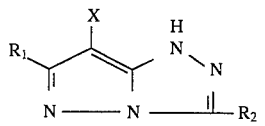

Formula V

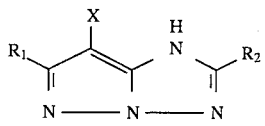

Formula VI wherein $R_1$ is an alkyl group, an alkoxy group or an aryloxy group; $R_2$ is an alkyl group or an aryl group, and X is a halogen atom, an alkoxy group or an aryloxy group. The group represented by $R_1$, $R_2$ or X each may be substituted with a substituent.

Alkyl groups represented by $R_1$ or $R_2$ include those having straight chain structure, branched chain structure and cyclic structure such as a methyl group, an ethyl group, an isopropyl group, tert-butyl group and cyclohexyl group. The alkyl moiety of an alkoxy group represented by $R_1$, $R_2$ or X is the same as the above-mentioned alkyl group. Aryl groups represented by $R_2$ include a phenyl group, a 1-naphthyl group and a 2-naphthyl group. Aryloxy groups represented by $R_1$ or X include a phenoxy group, a 1-naphthyloxy group and a 2-naphthyloxy group. Halogen atoms represented by X include a fluorine atom, a chlorine atom and a bromine atom.

The groups represented by $R_1$, $R_2$ or X each may be substituted with a substituent. The substituent includes an alkyl group, an aryl group, an acylamino group, a sulfonamido group, an alkylthio group, an arylthio group, an alkenyl group, a heterocyclic group, an alkylsulfonyl group, an arylsulfonyl group, an alkylsulfinyl group, an arylsulfinyl group, an alkylphosphonyl group, an aryl-phosphonyl group, an alkylcarbonyl group, an arylcarbonyl group, an alkylcarbamoyl group, an arylcarbamoyl group, an alkylsulfamoyl group, an arylsulfamoyl group, an alkoxy group, an aryloxy group, a cyano group, an alkylcarbonyloxy group, an arylcarbonyloxy group, an alkoxycaronyl group, an aryloxycarbonyl group, an amino group, a hydroxyl group, a carboxyl group, a sulfo group, an imido group, a ureido group, a urethane group and a halogen atom.

Among the groups represented by $R_1$, an alkyl group, particularly a branched chain alkyl group, is preferable. Among the groups represented by $R_2$, an alkyl group, particularly an alkyl group substituted by a group containing a heterocyclic group such as an acylamino group, a sulfonamido group, an acyloxy group, a carbamoyl group or an imido group, is preferable. An alkyl group substituted by a group represented by the following Formula A is further preferable;

Formula A

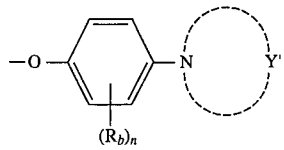

wherein

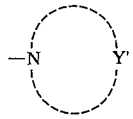

is a nitrogen-containing five- or six-member heterocyclic ring which further contains —O—, —$SO_2$—, —SO— or

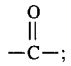

$R_b$ is a substituent; n is an integer of 0 to 4; and plurality of $R_b$ may be the same or different when n is 2 or more. Preferable substituents represented by $R_b$ include an alkyl group, an aryl group, an acylamino group, a sulfonamido group, an alkoxy group, an aryloxy group, an acyl group and a halogen atom.

Examples of the magenta-dye forming coupler are given below.

M-1

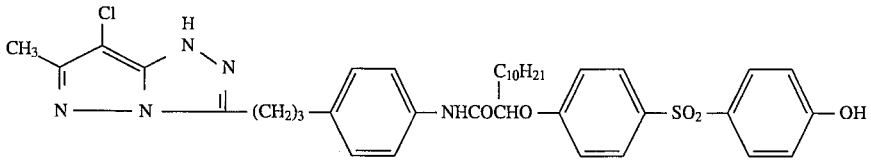

M-2

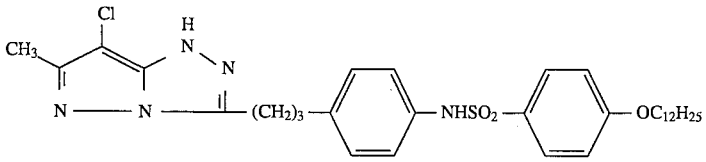

M-3

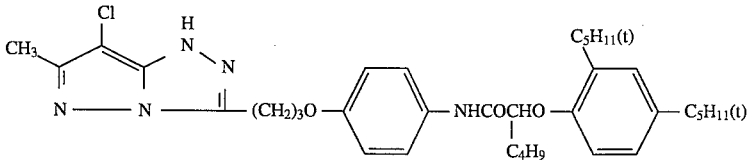

M-4

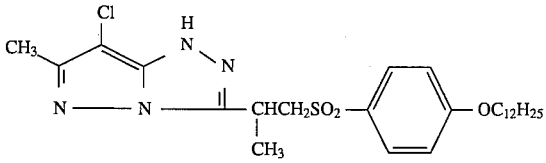

-continued
M-5
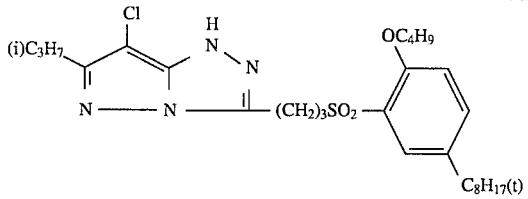
M-6
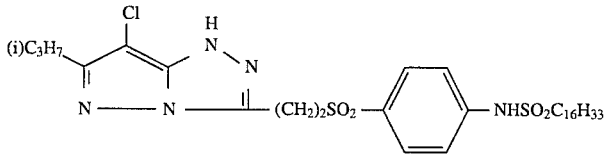
M-7
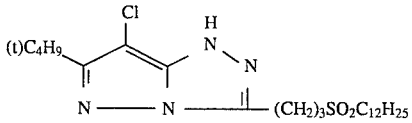
M-8
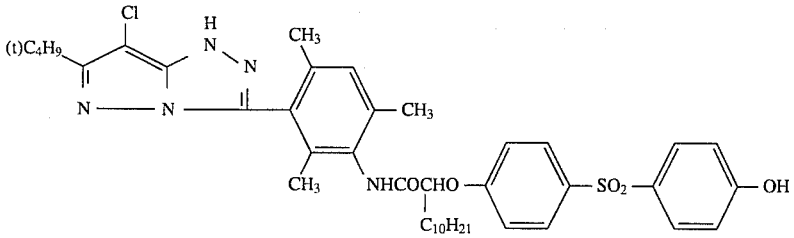
M-9
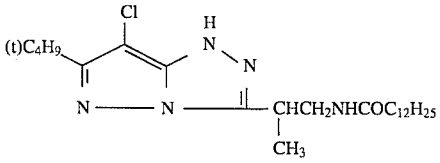
M-10
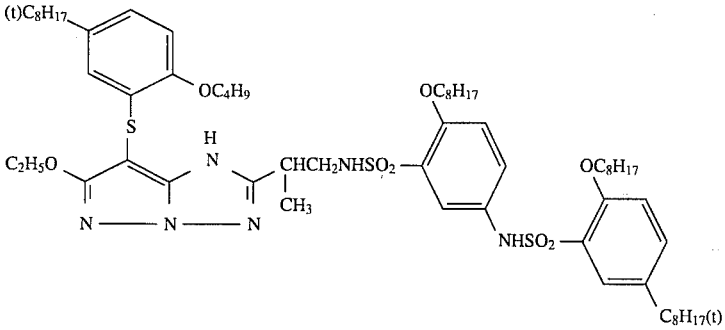
M-11
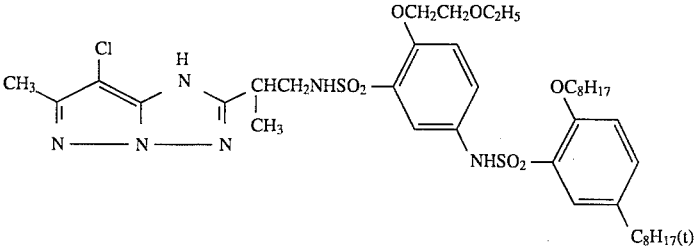
M-12
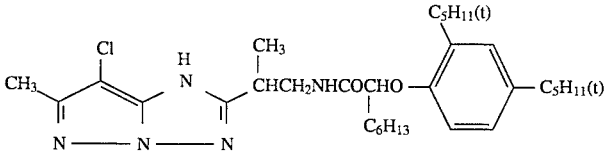

-continued
M-13
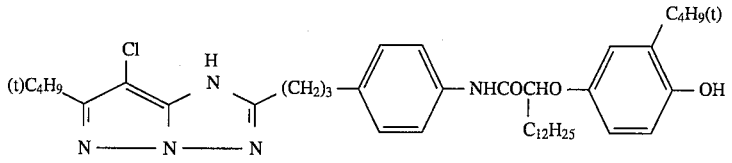
M-14
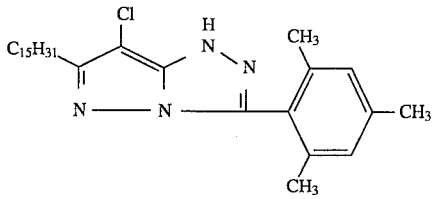
M-15
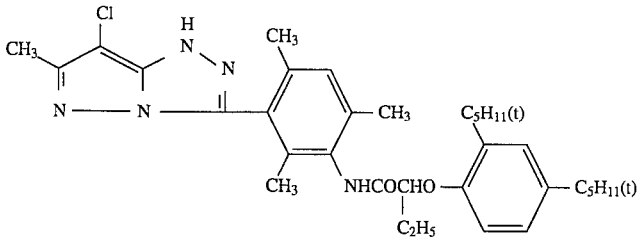
M-16
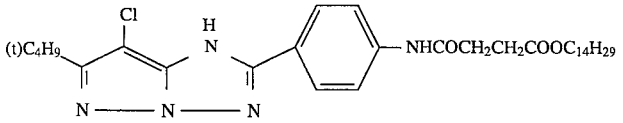
M-17
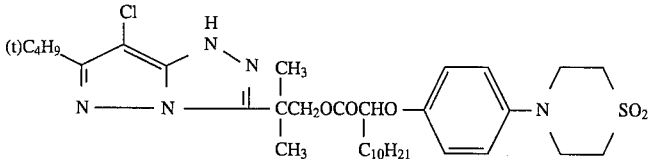
M-18
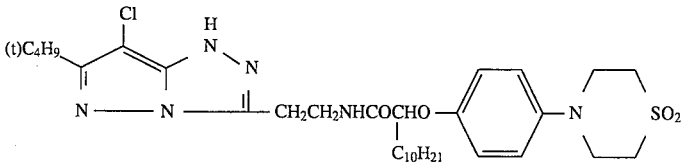
M-19
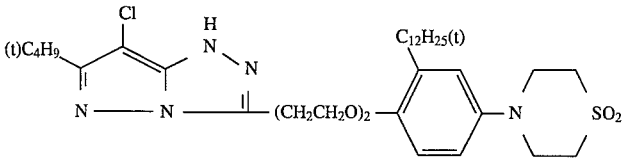
M-20
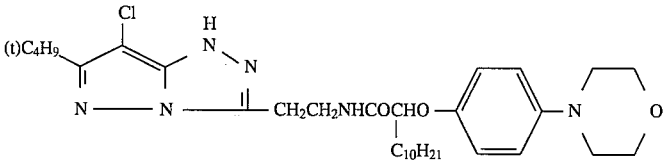

-continued

M-21

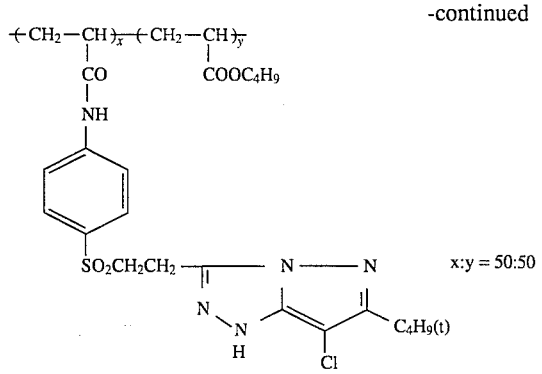

M-22

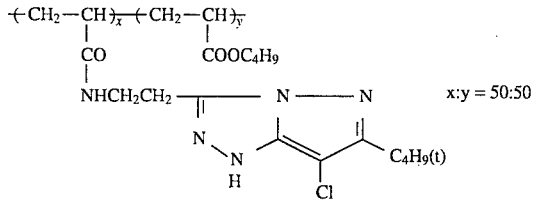

M-23

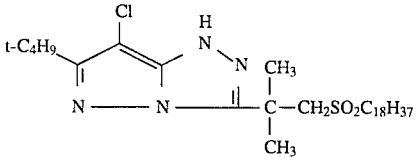

M-24

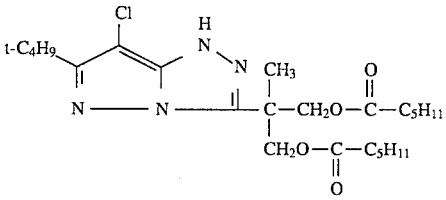

M-25

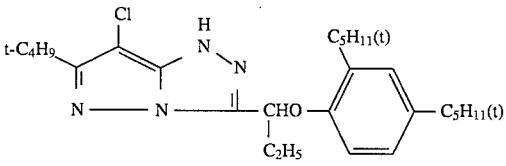

Beside the above-mentioned examples, the magenta-forming couplers represented by Formula V or VI include Compounds 1 to 7 described on page 6 of JP O.P.I.. Publication No. 61-292143 (1986), Compounds M-16 to M-34, M-37 to 39 and M-41 to M-47 described on pages 106 to 114 of JP O.P.I.. Publication No. 62-215172 (1987), Compounds 1 to 64 described on pages 5 to 9 of JP O.P.I.. Publication No. 63-253946 (1988), Compound M-1 to M-15 described on pages 12 to 14 of JP O.P.I.. Publication No. 2-96133 (1990), Compounds M-1 to M-21 described on pages 5 to 6 of JP O.P.I.. Publication No. 2-100048 (1990), Compounds 1 to 11, 15, 16, 18 to 28 and 30 to 41 described on pages 19 to 32 of JP O.P.I.. Publication No. 3-125143 (1991), Compounds 1 to 24 described on pages 3 to 5 of JP O.P.I. Publication No. 4-128744 (1992) and Compound 1 to 22 described on pages 5 to 7 of JP O.P.I.. Publication No. 4-242249 (1992).

Besides those mentioned above, other magenta dye-forming couplers include those compounds disclosed, for example, U.S. Pat. No. 3,684,514; British Patent No. 1,183,515; Japanese Patent Publication Nos. 40-6031(1965), 40-6035(1965), 44-15754 (1969), 45-40757 (1970) and 46-19032 (1971); Japanese Patent O.P.I. Publication Nos. 50-13041(1975). 53-129035(1978), 51-37646(1976), 55-62454(1980); U.S. Pat. No. 3,725,067; British Patent Nos. 1,252,418 and 1,334,515; Japanese Patent O.P.I.. Publication Nos. 59-171956(1984), 59-162548(1984), 60-43659(1985), 60-33552(1985); Research Disclosure No. 24626(1984); and Japanese Patent O.P.I. Publication Nos.61-120147(1986), 61-120148(1986), 61-120149(1986), 61-120152(1986), 61-230146(1986) and 61-230147(1986) can be mentioned. These compounds may be synthesized with reference to the method disclosed therein.

Next, as for representative specific examples of cyan dye-forming couplers, for example, exemplified compounds C-1 through C-24 disclosed in Japanese Patent O.P.I. Publication No. 4-313751(1992) can be mentioned.

Besides these compounds mentioned above, other cyan dye-forming couplers include those compounds disclosed, for example, U.S. Pat. Nos. 2,423,514730 and 2,801,171; Japanese Patent O.P.I. Publication Nos, 50-112038(1975), 50-134644(1975), 53-109630(1978), 54-98731(1979) and 59-31953(1984)can be mentioned and these compounds may be synthesized with reference to the method disclosed therein.

In order to incorporate the monohydric alcohol and the dye-forming coupler in a silver halide emulsion layer, it is possible to apply a method, in which the coupler is first dissolved in a monohydric alcohol of the invention or a mixture of the monohydric alcohol and conventionally known high boiling-point solvent, such as dibutyl phthalate, tricresyl phosphate, di-nonylphenol. A low boiling-point solvent such as butyl acetate, propionic acid, may be optionally added to the solution to easily dissolve the coupler. Then the coupler solution is mixed with an aqueous solution containing gelatin and a surface active agent. Subsequently, after the solution is subject to emulsification, using a high-speed rotary mixer, a colloid mill or a ultrasonic homogenize, this is incorporated in the emulsion, either directly or after it being is set, cut and washed with water.

In the present invention, it is preferable that both of the monohydric alcohol and the coupler are dissolved and emulsified, and, then, they are incorporated in the silver halide emulsion.

Amount of addition of the monohydric alcohol of the present invention with respect to the dye-forming coupler is, preferably, not less than 0.5 g, more preferably, 0.5 to 8.0 g per gram of dye-forming coupler.

As for silver halide emulsion used in the light-sensitive material of the present invention, any kind of silver halide emulsion which is known in the art can optionally be employed.

The emulsion may undergo a conventional chemical sensitization, and can be spectrally sensitized with a conventional sensitizing dye, to make the emulsion sensitive to lights of any pre-designed spectral region.

One or more kinds of photographic additives such as an anti-foggant and a stabilizer may be added to the silver halide emulsion. As for the binder for the emulsion, it is advantageous to use gelatin.

The silver halide emulsion layer and other hydrophilic colloidal layer may be hardened and comprise a plasticizer and a dispersion containing a polymer or a latex which is insoluble or sparsely soluble in water. Dye-forming coupler is used in the silver halide emulsion layer of the light-sensitive color photographic material of the present invention.

It is also possible to use a colored coupler, which functions a color compensator, a competing coupler, a compound which is, upon reaction with an oxidation product of a color developing agent capable of releasing a photographically useful fragment such as a development accelerator, a bleach accelerator, a developing agent, a solvent for the silver halide, a color toning agent, a hardener, a fogging agent, an anti-foggant, a chemical sensitizer, a spectral sensitizer, a desensitizing agent.

The light-sensitive photographic material of the present invention may have any optional auxiliary layer such as a filter layer, an anti-halation layer, an anti-irradiation layer. These layers and/or the silver halide emulsion layer may contain a dye, which either flows out of the photographic material or is capable of being bleached during development process. Further, the light-sensitive material may contain other photographic additive such as a matting agent, a lubricant, an image-stabilizer, a surface active agent, an anti-color foggant, a development accelerator, a development retarding agent and a bleach accelerator.

As for the support, for example, paper laminated with a polymer such as polyethylene, a polyethyleneterephthalate film, a baryta paper and a cellullose triacetate may be used.

In order to obtain a dye image using the light-sensitive material of the present invention, color photographic process which is generally known in the art may be applied.

Further when the monohydric alcohol of the present invention is incorporated in a green-sensitive layer it is preferable that the silver halide emulsion layer containing the magenta dye-forming coupler comprises at least one dye image-stabilizing agent represented by the following Formula AO-I or AO-II below:

Formula AO-I

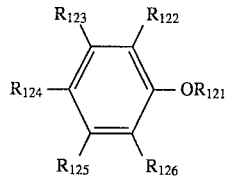

wherein $R_{121}$ represents a hydrogen atom, an alkyl group, an aryl group, a heterocyclic group. $R_{122}$, $R_{123}$, $R_{124}$, $R_{125}$ and $R_{126}$ independently represent a hydrogen atom, an aliphatic group or an aromatic group; Y represents a group of non-metal atoms necessary to five- to seven-member cycle together the nitrogen atom.

Formula AO-II

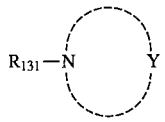

wherein $R_{131}$ represents an aliphatic group or an aromatic group; Y represents a group of non-metal atoms necessary to form a five- to seven-member cycle together with the nitrogen atom.

In the above-mentioned Formula AO-I, the alkyl group, the aryl group and the heterocyclic group represented by $R_{121}$ are each the same alkyl group and aryl group represented by R in the foregoing Formula IV can be mentioned and, as for the heterocyclic group, for example, a pyrazole group, a 2-imidazolyl group, 3-pyridile group and 2-furyl group can be mentioned. As for the monovalent organic group represented by $R_{121}a$, $R_{121}b$ and $R_{121}c$, for example an alkyl group, an aryl group, an alkoxy group, an aryloxy group and a halogen atom can be mentioned. As $R_{121}$, hydrogen atom or an alkyl group is preferable. The groups which are capable of being as substituent for the benzene ring are, for example, the same mentioned as the substituents for the alkyl and aryl group those represented by R in the foregoing Formula IV. As $R_{122'}$, $R_{123'}$, $R_{125'}$ and $R_{126'}$, hydrogen atom, a hydroxy group, an alkyl group, an aryl group, an alkoxy group, an aryloxy group and acylamino group are preferable; as $R_{124}$, an alkyl group, a hydroxy group, an aryl group, an alkoxy group and an aryloxy group are preferable. $R_{121}$ may form a five- or six-member ring by cyclization together with $R_{122}$. In this case, $R_{124}$ is preferably a hydroxy, alkoxy or aryloxy group. $R_{121}$ and $R_{122}$ further may form a methylenedioxy ring. Still further, $R_{121}$ and $R_{122}$ may form a five-member hydrocarbon ring and, in this case an alkyl group, an aryl group or a heterocyclic group is preferable as $R_{121}$.

Specific examples of the compound represented by Formula AO-I are given below:

Is-1

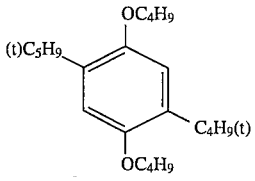

-continued

Is-2

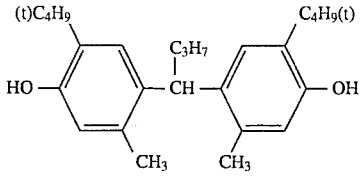

Is-3

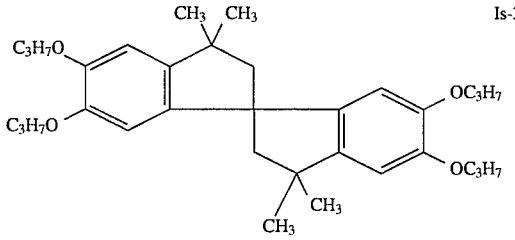

Is-4

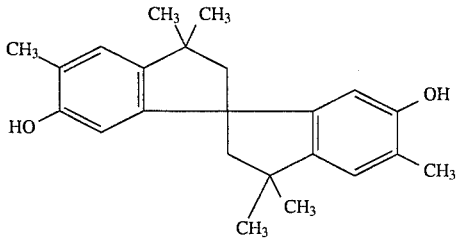

Is-5

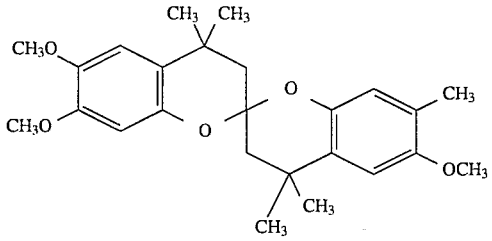

Is-6

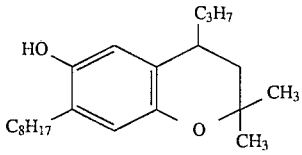

Is-7

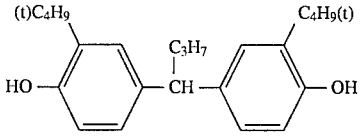

Is-8

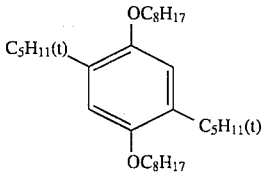

Is-9

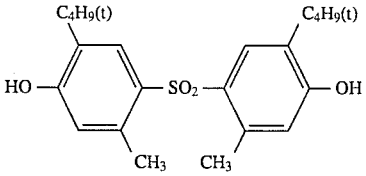

-continued

Is-10

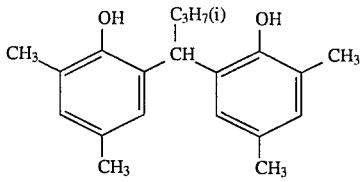

Besides those examples mentioned above, exemplified compounds A-1 through A-28 disclosed on pages 11 through 13 of Japanese Patent O.P.I. Publication No. 60-262159(1985), exemplified compounds PH-1 through PH-29 disclosed on pages 8 through 10 of Japanese Patent O.P.I. Publication No. 61-(1986), exemplified compounds B-1 through B-21 disclosed on pages 6 and 7 of Japanese Patent O.P.I. Publication No. 1-(1989), exemplified compounds I-1 through 1-13, I'-1 through I'-8, II-1 through II-12, II'-1 through II'-21, III-8 through III-14, IV-1 through IV-24 and V-13 through V-17 disclosed on pages 10 through 18 of Japanese Patent O.P.I. Publication No.2-958(1990) and exemplified compounds II-1 through II-33 disclosed on pages 10 and 11 of Japanese Patent O.P.I. Publication No. 3-39956(1991) can also be mentioned as examples of compounds represented by Formula AO-I.

Next in the above-mentioned Formula AO-II, $R_{131}$ represents an aliphatic group or an aromatic group. Preferably, it is an alkyl group, an aryl group or a heterocyclic group and, most advantageously it is an aryl group. The heterocycles represented by Y together with the nitrogen atom include, for example, a pyperidine ring, a pyperadine ring, a morpholine ring, a thiomorpholine ring, a thiomorpholino-1,1-dione ring and pyrrolidine ring.

Examples of the compound represented by Formula AO-II are given below:

IIs-1

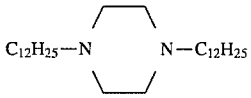

IIs-2

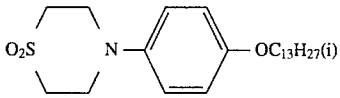

IIs-3

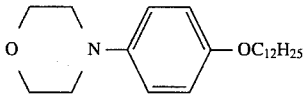

IIs-4

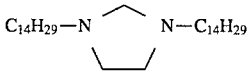

IIs-5

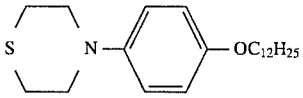

IIs-6

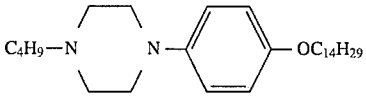

Besides those examples mentioned above, for example, exemplified compounds B-1 through B-65 disclosed on pages 8 through 11 of Japanese Patent O.P.I. Publication No. 2-167543(1990) and exemplified compounds (1) through (120) disclosed on pages 4 through 7 of Japanese Patent O.P.I. Publication No. 63-95439(1988), can also be mentioned as other specific examples of the compound represented by Formula AO-II.

Amount of addition of the compound represented by the above-mentioned Formula AO-I or AO-II is, generally in the range between 5 and 500 mol % and, more preferably, between 20 and 200 mol % with respect to 100 mol % of the coupler.

When the monohydric alcohol of the present invention is incorporated in the green-sensitive layer, chelating compounds disclosed in, for example, Japanese Patent O.P.I. Publication Nos. 61-158329(1986) and 62-183459(1987) may be used in the layer.

EXAMPLES

Example 1

On a photographic paper support, one surface of which is laminated with polyethylene and the other surface of which is laminated with polyethylene containing titan oxide, the following layers shown in Table 1 are provided in order on the side laminated with polyethylene containing titan oxide, to prepare Sample 101 of a multi-layer silver halide light-sensitive color photographic material.

Coating solution was prepared as follows:

First layer coating solution

Sixty ml of ethyl actate was added to a mixture of 26.7 g of yellow dye-forming coupler (Y-9), 10.0 g of dye image stabilizer (ST-1), 6.67 g of dye image stabilizer (ST-2), 0.67 g of an anti-staining agent (HQ-1) and 6.67 g of High boilingpoint organic solvent (DNP) and dissolved the mixture therein. Then this solution was added to 220 ml of 20% aqueous gelatin solution containing 7 ml of surface active agent (SU=2) by the use of a ultrasonic homogenizer, to prepare a dispersion of yellow dye-forming coupler.

Then, this dispersion solution was mixed with a blue-sensitive silver halide emulsion and, further, an anti-irradiation dye (AIY) was added to prepare a coating solution for the first layer.

The second through the seventh layers were prepared in the similar manner as the first layer. As a gelatin hardener, (HH-1) was added to the second and the fourth layers and (HH- 2) to the seventh layer. Moreover, surface active agents (SU- 1) and (SU-2) were used as coating aids and adjusted the surface tension of the coating solution.

TABLE 1

| Layer | Composition | Amount ($g/m^2$) |
|---|---|---|
| Seventh Layer (protective Layer) | Gelatin | 1.00 |
| Sixth Layer (UV-Ray Absorbing Layer) | Gelatin | 0.40 |
| | UV-Ray Absorbent (UV-1) | 0.10 |
| | UV-Ray Absorbent (UV-2) | 0.04 |
| | UV-Ray Absorbent (UV-3) | 0.16 |

TABLE 1-continued

| Layer | Composition | Amount ($g/m^2$) |
|---|---|---|
| | Anti-Staining Agent (HQ-1) | 0.01 |
| | DNP | 0.20 |
| | PVP | 0.03 |
| | Anti-Irradiation Dye (AIC-1) | 0.02 |
| Fifth Layer (Red-Sensitive Layer) | Gelatin | 1.30 |
| | Red-Sensitive Silver Chlorobromide Emulsion (Em-R) | 0.21 |
| | Cyan Dye-Forming Coupler (C-3) | 0.24 |
| | Cyan Dye-Forming Coupler (C-6) | 0.08 |
| | Dye Image-Stabilizer (ST-1) | 0.20 |
| | Anti-Staining Agent (HQ-1) | 0.01 |
| | HBS-1A | 0.20 |
| | DOP | 0.20 |
| Fourth Layer (UV-Ray Absorbing Layer) | Gelatin | 0.94 |
| | UV Absorbent (UV-1) | 0.28 |
| | UV Absorbent (UV-2) | 0.09 |
| | UV Absorbent (UV-3) | 0.38 |
| | Anti-Staining Agent (HQ-1) | 0.03 |
| | DNP | 0.40 |
| Third Layer (Green-Sensitive Layer) | Gelatin | 1.40 |
| | Green-Sensitive Silver Chlorobromide Emulsion (Em-G) | 0.17 |
| | Magenta Dye-Forming Coupler (M-12) | 0.35 $g/m^2$ (0.75* $mmol/m^2$) |
| | DNP | 0.20 |
| | Dye Image Stabilizer (Is-8) | 0.36 $g/m^2$ (0.75* $mmol/m^2$) |
| | Anti-Irradiation Dye (AIM-1) | 0.01 |
| Second Layer (Intermediate Layer) | Gelatin | 1.20 |
| | Anti-Staining Agent (HQ-2) | 0.03 |
| | Anti-Staining Agent (HQ-3) | 0.03 |
| | Anti-Staining Agent (HQ-4) | 0.05 |
| | Anti-Staining Agent (HQ-5) | 0.23 |
| | DIDP | 0.06 |
| | Anti-Mold (F-1) | 0.002 |
| First Layer (Blue-Sensitive Layer) | Gelatin | 1.20 |
| | Blue-Sensitive Silver Chlorobromide Emulsion (Em-B) | 0.26 |
| | Yellow Dye-Forming Coupler (Y-9) | 0.80 |
| | Dye Image Stabilizer (ST-1) | 0.30 |
| | Dye Image Stabilizer (ST-2) | 0.20 |
| | Anti-Staining Agent (HQ-1) | 0.02 |
| | Anti-irradiation Dye (AIY-1) | 0.01 |
| | DIDP | |
| Support | Paper laminated with polyethylene | |

In the above, the amounts of M-29 and Is-8, indicated by asterisks are expressed by $millimol/m^2$ and the amount of the silver halide emulsions are mentioned in terms of silver.

Compounds used in the above-mentioned layers are given below.

Y-9
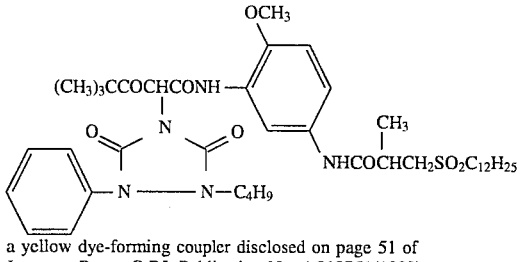
a yellow dye-forming coupler disclosed on page 51 of Japanese Patent O.P.I. Publication No. 4-313751(1992)
C-3
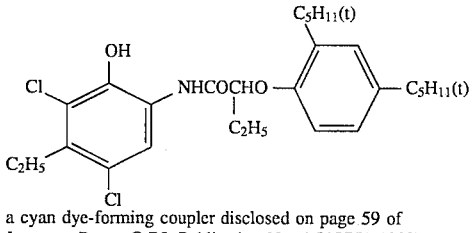
a cyan dye-forming coupler disclosed on page 59 of Japanese Patent O.P.I. Publication No. 4-313751(1992)
C-6
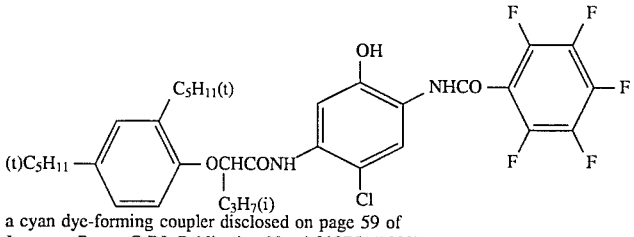
a cyan dye-forming coupler disclosed on page 59 of Japanese Patent O.P.I. Publication No. 4-313751(1992)
M-5
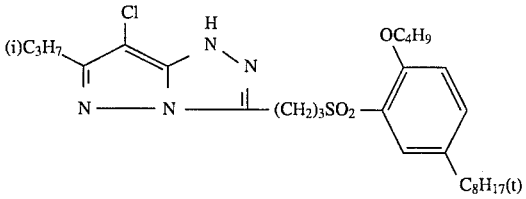
ST-1
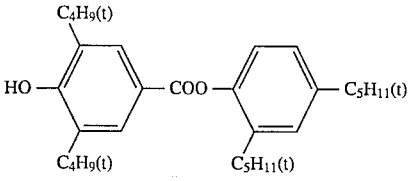
ST-2
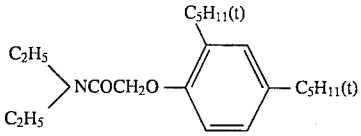
UV-1
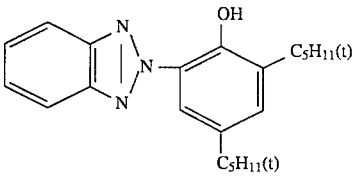

-continued
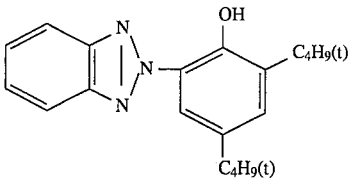
UV-2
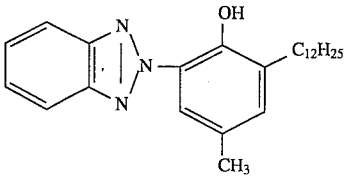
UV-3
| | |
|---|---|
| Di-octylphthalate | DOP |
| Di-nonylphthalate | DNP |
| Di-isodecylphthalate | DIDP |
| Polyvinyl pyrrolidone | PVP |
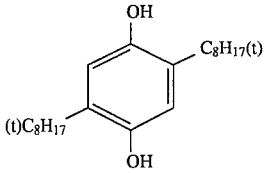
HQ-1
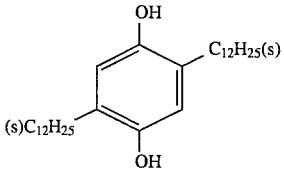
HQ-2
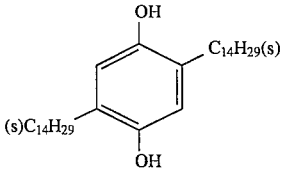
HQ-3
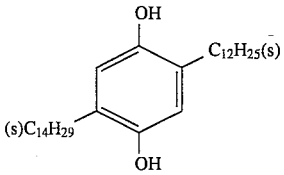
HQ-4
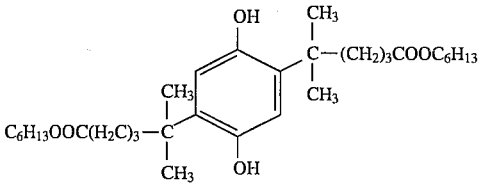
HQ-5
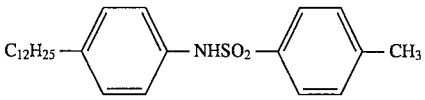
HBS-1A -continued

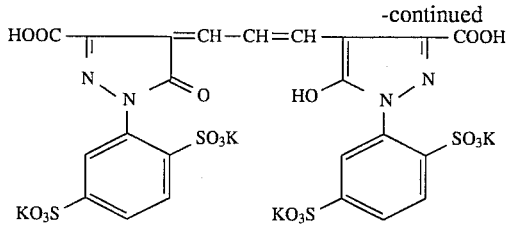

AIM-1

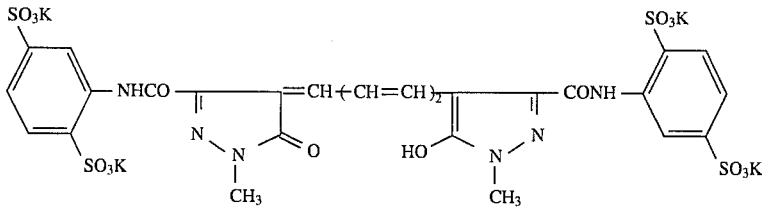

AIC-1

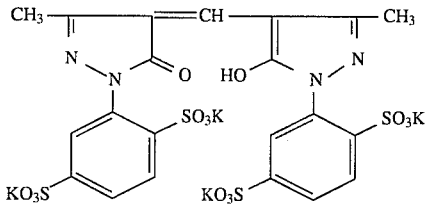

AIY-1

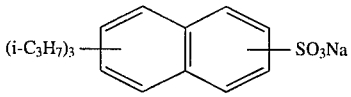

SU-1

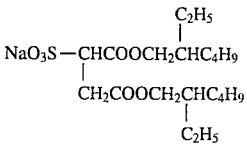

SU-2

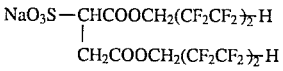

SU-3

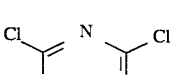

HH-1

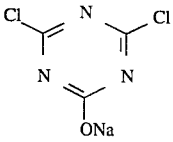

HH-2

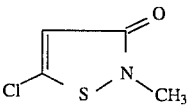

F-1

Blue-sensitive silver halide emulsion:

A mono-disperse silver chlorobromide emulsion containing cubic-shaped silver halide crystals, of which average grain size, coefficient of variation and chloride content are 0.07 μm, 0.07 and 99.5 mol %, respectively.

| | |
|---|---|
| Sodium thiosulfate | 0.8 mg/mol AgX |
| Chloro aurate | 0.5 mg/mol AgX |
| Stabilizer (STAB-1) | $6 \times 10^{-4}$ mol/mol Ag X |
| Sensitizing Dye (BS-1) | $4 \times 10^{-4}$ mol/mol Ag X |
| Sensitizing Dye (BS-2) | $1 \times 10^{-4}$ mol/mol Ag X |

Green-sensitive silver halide emulsion:

A mono-disperse silver chlorobromide emulsion containing cubic-shaped silver halide crystals, of which average grain size, coefficient of variation and chloride content are 0.43 μm, 0.08 and 99.5 mol %, respectively.

| | |
|---|---|
| Sodium thiosulfate | 1.5 mg/mol AgX |
| Chloro aurate | 1.0 mg/mol AgX |
| Stabilizer (STAB-1) | $6 \times 10^{-4}$ mol/mol Ag X |
| Sensitizing Dye (GS-1) | $4 \times 10^{-4}$ mol/mol Ag X |

Red-sensitive silver halide emulsion:

A mono-disperse silver chlorobromide emulsion containing cubic-shaped silver halide crystals, of which average grain size, coefficient of variation and chloride content are 0.50 μm, 0.08 and 99.5 mol %, respectively.

| | |
|---|---|
| Sodium thiosulfate | 1.8 mg/mol AgX |
| Chloro aurate | 2.0 mg/mol AgX |
| Stabilizer (STAB-1) | $6 \times 10^{-4}$ mol/mol Ag X |
| Sensitizing Dye (RS-1) | $1 \times 10^{-4}$ mol/mol Ag X |

Next, chemical structures of the compounds used in the respective mono-disperse silver halide emulsions are shown:

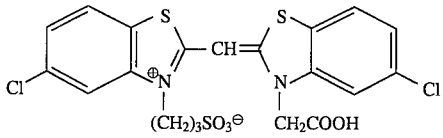

BS-1

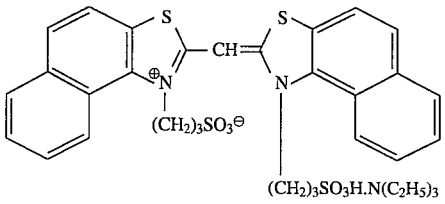

BS-2

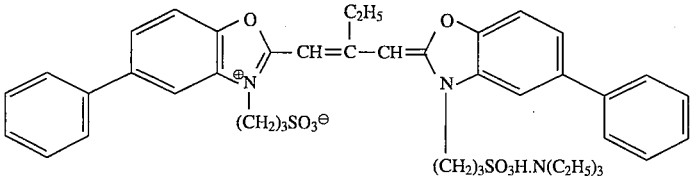

GS-1

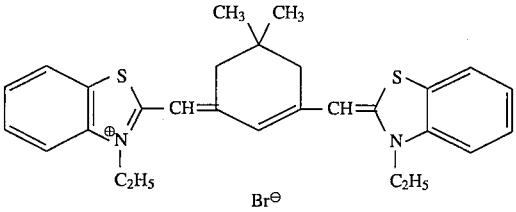

RS-1

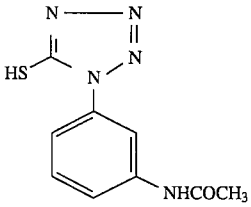

STAB-1

Next, Samples 102 through 120 and 104' through 121' were prepared in the same manner as Sample 101, except that in these samples the same weight of comparative HBS as shown in Tables 2 and 3 and the monohydric alcohol of the present invention were used in the third layer of Sample 101.

Thus prepared samples were subjected to exposure to green light through an optical wedge and, then to color developing process consisting of the following steps:

| Processing Step | Temperature (°C.) | Time |
|---|---|---|
| color Development | 35.0 ± 0.3 | 45" |
| Bleach-Fixing | 35.0 ± 0.5 | 45" |
| Stabilization | 30–34 | 90" |
| Drying | 60–80 | 60" |

Replenishing amounts of each processing solution was 80 ml per $m^2$ of the light-sensitive material processed thereby.

Compositions of the respective processing solutions are shown below:

| Color Developing Solution | Tank Solution | Replenisher |
|---|---|---|
| pure water | 800 ml | 800 ml |
| Triethanolamine | 10 g | 18 g |
| N,N-diethylhydroxylamine | 5 g | 9 g |
| potassium chloride | 2.4 g | |
| 1-hydroxyethylidene-1,1-diphosphonic acid | 1.0 g | 1.8 g |
| N-ethyl-N-β-methanesulfonamidoethyl-3-methyl-4-aminoaniline sulfate | 5.4 g | 8.2 g |
| Fluorescent brightening agent | 1.0 g | 1.8 g |

-continued

| Color Developing Solution | Tank Solution | Replenisher |
|---|---|---|
| (4,4-diaminostilbene sulfonate derivative | | |
| potassium carbonate | 27 g | 27 g |

Add water to make the total volume 1000 ml, and adjust the pH of the solution at 10.10 for tank solution and 10.60 for replenisher, respectively.

Bleach-fixing solution (composition of the solutions for the tank and replenisher are same.)

| | |
|---|---|
| Ferric ammonium ethylenediaminetetraacetate dihydride | 60 g |
| Ethylenediaminetetraacetic acid | 3 g |
| Ammonium thiosulfate (70% aqqueous solution) | 100 ml |
| Ammonium thiosulfite (40% aqueous solution) | 27.5 ml |

Add water to make the total volume 1000 ml and adjust pH of the solution with potassium carbonate or glacial acetic acid at 5.7.

Stabilizing Solution (composition of the solutions for the tank and replenisher are same.)

| | |
|---|---|
| 5-Chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetracetic acid | 1.0 g |
| Ammonium hydroxide (20% aqueous solution) | 3.0 g |

-continued

| | |
|---|---|
| Fluorescent brightening agent (4,4-diaminostilbene sulfonate derivative) | 1.5 g |

Add water to make the total volume 1000 ml and adjust pH with potassium carbonate or sulfric acid at 7.0

Using samples, which were subjected to continuous processing, the following evaluations were conducted. Fastness against light: Samples were exposed to light by the use of a xenon fade meter for 14 days and the residual proportion of the density of dye image at the portion of an image, at which first image density was 1.0 was obtained.

λmax: This represents tile maximum absorption wavelength of the wedge at the portion of which reflective optical density is 1,0.

Half-value width: measured from spectral absorption spectrum of the wedge of which reflection optical density is 1.0.

Dmax: This represents the maximum developed density.

Results are shown in Tables 2 and 3.

TABLE 2

| Sample No. | HBS in the Third Layer | Amount ($g/m^2$) | λmax | Half-Value Width (nm) | Dmax | Durability against Light (Residual Ratio of Dye; %) |
|---|---|---|---|---|---|---|
| 101 (Comp.) | DNP | 0.20 | 547 | 112 | 1.95 | 58 |
| 102 (Comp.) | HBS-1 | 0.20 | 561 | 126 | 1.83 | 60 |
| 103 (Comp.) | HBS-2 | 0.20 | 548 | 114 | 2.02 | 59 |
| 104 (Inv.) | I-3 | 0.20 | 546 | 108 | 2.09 | 64 |
| 105 (Inv.) | I-4 | 0.20 | 546 | 108 | 2.09 | 64 |
| 106 (Inv.) | I-5 | 0.20 | 547 | 109 | 2.10 | 66 |
| 107 (Inv.) | I-7 | 0.20 | 546 | 108 | 2.08 | 63 |
| 108 (Inv.) | I-19 | 0.20 | 546 | 109 | 2.10 | 65 |
| 109 (Inv.) | I-21 | 0.20 | 547 | 109 | 2.09 | 66 |
| 110 (Inv.) | I-43 | 0.20 | 546 | 109 | 2.10 | 65 |
| 111 (Comp.) | DNP | 0.60 | 547 | 110 | 1.94 | 59 |
| 112 (Comp.) | HBS-1 | 0.60 | 562 | 123 | 2.05 | 62 |
| 113 (Comp.) | HBS-2 | 0.60 | 548 | 112 | 2.05 | 62 |
| 114 (Inv.) | I-3 | 0.60 | 546 | 106 | 2.12 | 68 |
| 115 (Inv.) | I-4 | 0.60 | 546 | 106 | 2.12 | 68 |
| 116 (Inv.) | I-5 | 0.60 | 547 | 106 | 2.13 | 70 |
| 117 (Inv.) | I-7 | 0.60 | 546 | 107 | 2.11 | 67 |
| 118 (Inv.) | I-19 | 0.60 | 547 | 106 | 2.14 | 72 |
| 119 (Inv.) | I-21 | 0.60 | 546 | 105 | 2.13 | 72 |
| 120 (Inv.) | I-43 | 0.60 | 547 | 106 | 2.14 | 72 |

TABLE 3

| Sample No. | HBS in the Third Layer | Amount ($g/m^2$) | λmax | Half-Value Width (nm) | Dmax | Durability against Light (Residual Ratio of Dye; %) |
|---|---|---|---|---|---|---|
| 101 (Comp.) | DNP | 0.20 | 547 | 112 | 1.95 | 58 |
| 102 (Comp.) | HBS-1 | 0.20 | 561 | 126 | 1.83 | 60 |
| 103 (Comp.) | HBS-2 | 0.20 | 548 | 114 | 2.02 | 59 |

TABLE 3-continued

| Sample No. | HBS in the Third Layer | Amount ($g/m^2$) | λmax | Half-Value Width (nm) | Dmax | Durability against Light (Residual Ratio of Dye; %) |
|---|---|---|---|---|---|---|
| 104' (Inv.) | II-1 | 0.20 | 547 | 108 | 2.11 | 68 |
| 105' (Inv.) | II-8 | 0.20 | 547 | 109 | 2.10 | 67 |
| 106' (Inv.) | II-16 | 0.20 | 546 | 109 | 2.10 | 65 |
| 107' (Inv.) | III-1 | 0.20 | 547 | 108 | 2.11 | 68 |
| 108' (Inv.) | III-4 | 0.20 | 547 | 109 | 2.12 | 69 |
| 109' (Inv.) | III-13 | 0.20 | 546 | 108 | 2.10 | 66 |
| 110' (Inv.) | III-22 | 0.20 | 547 | 109 | 2.12 | 68 |
| 111' (Inv.) | II-7/III-7 | 0.10/0.10 | 547 | 109 | 2.11 | 67 |
| 111 (Comp.) | DNP | 0.60 | 547 | 110 | 1.94 | 59 |
| 112 (Comp.) | HBS-1 | 0.60 | 562 | 123 | 2.05 | 62 |
| 113 (Comp.) | HBS-2 | 0.60 | 548 | 112 | 2.05 | 62 |
| 114' (Inv.) | II-1 | 0.60 | 547 | 104 | 2.13 | 74 |
| 115' (Inv.) | II-8 | 0.60 | 546 | 105 | 2.12 | 75 |
| 116' (Inv.) | II-16 | 0.60 | 546 | 106 | 2.12 | 71 |
| 117' (Inv.) | III-1 | 0.60 | 547 | 104 | 2.13 | 74 |
| 118' (Inv.) | III-4 | 0.60 | 547 | 103 | 2.15 | 76 |
| 119' (Inv.) | III-13 | 0.60 | 546 | 105 | 2.10 | 70 |
| 120' (Inv.) | III-22 | 0.60 | 547 | 104 | 2.14 | 76 |
| 121' (Inv.) | II-7/III-7 | 0.30/0.30 | 547 | 105 | 2.12 | 76 |

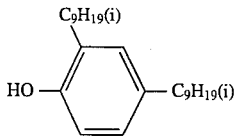

HBS-1

$C_8H_{17}CH{=}CH(CH_2)_8OH$ HBS-2

(high boiling-point organic solvent disclosed in British Patent No. 486,929.)

It is obvious from Tables 2 and 3 that Samples 104 through 110 and 104' through 110', which were prepared according to the present invention and in which the compound of the present invention is used as the high boiling-point organic solvent have improved durability against light as well as enhanced dye-forming efficiency in comparison with comparative Sample 101. Moreover, it was found that the samples according to the present invention have an effect of sharpening spectral absorption of dye image without shifting the maximum absorption wavelength. To the contrary, Sample 102, in which HBS-1 which is a phenol derivative is used, has shown a slight improvement in the durability against light, however, its performance is still insufficient and, in addition, the absorption wavelength of the dye image was shifted to the longer wavelength side, it was further found that it had an effect of broadening the absorption, which is undesirable in the light of color reproduction.

Further, Sample 103, in which HBS-2 which is not according to the invention is used, although there was no obvious deterioration in the color reproduction, substantially no improvement in the durability against light was observed.

In Samples 111 through 121', in which three times as much high boiling-point organic solvent (HBS) with respect to the amount used in Sample 101, it was found that the effect monohydric alcohol of the invention was exerted more effectively in the light of both durability against light and sharpening of the light absorption.

Example 2

Samples 200 (for comparison) and 201 through 220 (according to the present invention) were prepared in the same manner as Sample 101, except that in these samples magenta coupler, high boiling-point organic solvent and dye image stabilizer used in the third layer of Sample 101 were replaced with those as shown in Table 5. The amount of magenta coupler M-5 was 0.35 $g/m^2$. Using thus prepared samples, the same evaluation as Example 1 was conducted. Results are shown in Table 4.

TABLE 4

| Sample No. | Magenta Coupler in the Third Layer | HBS (Amount in $g/m^2$) | Dye-Image Stabilizer (Amount in $g/m^2$) | Durability (Residual Ratio in %) |
|---|---|---|---|---|
| 200 (Comp.) | M-5 | DNP (0.20) | Is-9 (0.29), IIs-2. (0.31) | 41 |
| 201 (Inv.) | M-5 | I-1 (0.20) | Is-9 (0.29), IIs-2. (0.31) | 55 |
| 202 (Inv.) | M-5 | I-1 (0.60) | Is-9 (0.29), IIs-2. (0.31) | 64 |
| 203 (Inv.) | M-5 | I-6 (0.20) | Is-9 (0.29), IIs-2. (0.31) | 56 |
| 204 (Inv.) | M-5 | I-6 (0.60) | Is-9 (0.29), IIs-2. (0.31) | 65 |
| 205 (Inv.) | M-5 | I-19 (0.20) | Is-9 (0.29), IIs-2. (0.31) | 56 |
| 206 (Inv.) | M-5 | I-19 (0.60) | Is-9 (0.29), IIs-2. (0.31) | 64 |
| 207 (Inv.) | M-5 | I-44 (0.20) | Is-9 (0.29), IIs-2. (0.31) | 55 |
| 208 (Inv.) | M-5 | I-44 (0.60) | Is-9 (0.29), IIs-2. (0.31) | 64 |
| 209 (Inv.) | M-5 | II-7 (0.20) | Is-9 (0.29), IIs-2. (0.31) | 58 |
| 210 (Inv.) | M-5 | II-7 (0.60) | Is-9 (0.29), IIs-2. (0.31) | 69 |

TABLE 4-continued

| Sample No. | Magenta Coupler in the Third Layer | HBS (Amount in g/m$^2$) | Dye-Image Stabilizer (Amount in g/m$^2$) | Durability (Residual Ratio in %) |
|---|---|---|---|---|
| 211 (Inv.) | M-5 | II-10 (0.20) | Is-9 (0.29), IIs-2. (0.31) | 56 |
| 212 (Inv.) | M-5 | II-10 (0.60) | Is-9 (0.29), IIs-2. (0.31) | 67 |
| 213 (Inv.) | M-5 | II-19 (0.20) | Is-9 (0.29), IIs-2. (0.31) | 54 |
| 214 (Inv.) | M-5 | II-19 (0.60) | Is-9 (0.29), IIs-2. (0.31) | 64 |
| 215 (Inv.) | M-5 | III-7 (0.20) | Is-9 (0.29), IIs-2. (0.31) | 58 |
| 216 (Inv.) | M-5 | III-7 (0.60) | Is-9 (0.29), IIs-2. (0.31) | 70 |
| 217 (Inv.) | M-5 | III-19 (0.20) | Is-9 (0.29), IIs-2. (0.31) | 53 |
| 218 (Inv.) | M-5 | III-19 (0.60) | Is-9 (0.29), IIs-2. (0.31) | 64 |
| 219 (Inv.) | M-5 | III-24 (0.20) | Is-9 (0.29), IIs-2. (0.31) | 59 |
| 220 (Inv.) | M-5 | III-24 (0.60) | Is-9 (0.29), IIs-2. (0.31) | 68 |

Magenta Dye-Forming Coupler (M-5) 0.35 g/m$^2$

It is obvious that durability against light can be improved to a considerable extent by using a magenta dye-forming coupler, M-5, wherein 6-position of the coupler is substituted by a secondary alkyl group, together with the monohydric alcohol as a high boiling-point organic solvent.

It was also understood that Samples 202, 204, 206, 208,210, 212, 214, 216, etc. had shown intensively enhanced fastness against light.

Example 3

Samples 101 and 201' through 216' were prepared in the same manner as Sample 101 in Example 1, except that in these samples, the high boiling-point organic solvent used in the third layer was replaced with the combinations as shown in Table 5 below. Using thus prepared samples, the same evaluation as Example 1 was conducted. Results are shown in Table 5.

TABLE 5

| Sample No. | HBS in the Third Layer (Amount in g/m$^2$) | Weight Ratio of Monohydric Alcohol and Coupler (*MHA/Cp) | Durability against Light (Residual Ratio in %) |
|---|---|---|---|
| 101 (Comp.) | DNP (0.2) | 0 | 58 |
| 201' (Inv.) | DNP (0.18)<br>I-3 (0.02) | 0.057 | 58 |
| 202' (Inv.) | DNP (0.1)<br>I-3 (0.1) | 0.29 | 58 |
| 203' (Inv.) | DNP (0.02)<br>I-3 (0.18) | 0.51 | 62 |
| 204' (Inv.) | I-3 (0.2) | 0.57 | 64 |
| 205' (Inv.) | DNP (0.18)<br>I-43 (0.02) | 0.057 | 58 |
| 206' (Inv.) | DNP (0.1)<br>I-43 (0.1) | 0.29 | 58 |
| 207' (Inv.) | DNP (0.02)<br>I-43 (0.18) | 0.51 | 62 |
| 208' (Inv.) | I-43 (0.20) | 0.57 | 65 |
| 209' (Inv.) | DNP (0.18)<br>II-1 (0.02) | 0.057 | 58 |
| 210' (Inv.) | DNP (0.1) | 0.29 | 58 |
| 211' (Inv.) | DNP (0.02)<br>II-1 (0.18) | 0.51 | 65 |
| 212' (Inv.) | II-1 (0.2) | 0.57 | 68 |
| 213' (Inv.) | DNP (0.18)<br>III-22 (0.02) | 0.057 | 58 |
| 214' (Inv.) | DNP (0.1)<br>III-22 (0.1) | 0.29 | 58 |
| 215' (Inv.) | DNP (0.02)<br>III-22 (0.18) | 0.51 | 64 |
| 216' (Inv.) | III-22 (0.2) | 0.57 | 68 |

*MHA: monohydric alcohol according to the present invention

It is obvious from Table 5 that sufficient effect is not obtainable when the amount of the monohydric alcohol of the present invention is less than 50% by weight with respect to magenta dye-forming coupler(cf. Samples 201', 202' 205' 206' 209' 210', 213' and 214'), whereas great enhancement in the light fastness effect is found when the monohydric alcohol and, especially, when the total amount of DNP was replaces with the monohydric alcohol according to the present invention.

What is claimed is:

1. A silver halide color photographic light-sensitive material comprising a support and a silver halide emulsion layer provided on said support wherein said silver halide emulsion layer contains oleophilic fine particles dispersed therein which comprises a water-insoluble monohydric alcohol represented by the following Formula I, II or III and a color-forming coupler in a ratio of said water-insoluble monohydric alcohol to said color-forming coupler of 50% or more by weight;

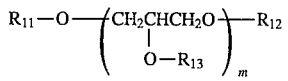

Formula I wherein m is an integer of 1 to 20; one of $R_{11}$, $R_{12}$ and $R_{13}$ in number of m is a hydrogen atom and other groups represented by $R_{11}$, $R_{12}$ and $R_{13}$ are each an acyl group; and the total number of carbon atoms contained in the acyl groups represented by $R_{11}$, $R_{12}$ and $R_{13}$ are not less than 8;

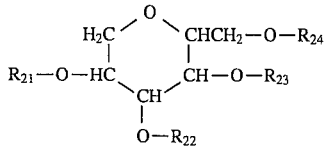

Formula II wherein one of $R_{21}$, $R_{22}$, $R_{23}$ and $R_{24}$ is a hydrogen atom and other groups represented by $R_{21}$, $R_{22}$, $R_{23}$ and $R_{24}$ are each an acyl group and the total number of carbon atoms contained in the acyl groups represented by $R_{21}$, $R_{22}$, $R_{23}$ and $R_{24}$ is not less than 12;

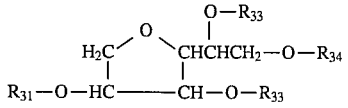

Formula III wherein one of $R_{31}$, $R_{32}$, $R_{33}$ and $R_{34}$ is a hydrogen atom and other groups represented by $R_{31}$, $R_{32}$, $R_{33}$ and $R_{34}$ are each an acyl group and the total number of carbon atoms contained in the acyl groups represented by $R_{31}$, $R_{32}$, $R_{33}$ and $R_{34}$ is not less than 12.

2. The light-sensitive material of claim 1, wherein said ratio of the monohydric alcohol to the coupler is 50% to 800%.

3. The light-sensitive material of claim 1, wherein said color-forming coupler is a magenta-dye forming coupler.

4. The light-sensitive material of claim 3, wherein said magenta-dye forming coupler is a compound represented by Formula V or VI;

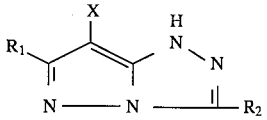

Formula V

-continued

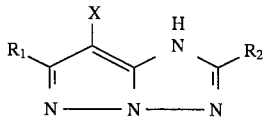

Formula VI wherein $R_1$ is an alkyl group, an alkoxy group or an aryloxy group; $R_2$ is an alkyl group or an aryl group, and X is a halogen atom, an alkoxy group or an aryloxy group.

5. The light-sensitive material claim 3, wherein said magenta coupler containing emulsion layer further contains a compound represented by Formula AO-I or AO-II;

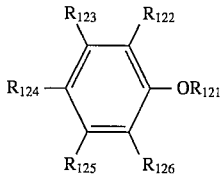

Formula AO-I wherein $R_{121}$ is a hydrogen atom, an alkyl group, an aryl group or a heterocyclic group; $R_{121}$, $R_{122}$, $R_{123}$, $R_{124}$, $R_{125}$ and $R_{126}$ are each an alkyl group, an alkenyl group, a cycloalkenyl group, an alkinyl group, an aryl group, a heterocyclic group, an alkylthio group, an arylthio group, a heterocyclic thio group, a sulfonyl group, a sulfinyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an anilino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, a residue of a spiro compound, a residue of bridged carbon hydride compound or a halogen atom;

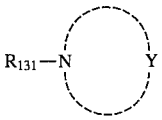

Formula AO-II wherein $R_{131}$ is an alkyl group, an aryl group or a heterocyclic group; and Y is a group of atoms necessary to form a heterocyclic ring together with the nitrogen atom.

* * * * *